US007931000B2

(12) United States Patent
Ushida et al.

(10) Patent No.: US 7,931,000 B2
(45) Date of Patent: Apr. 26, 2011

(54) VALVE TIMING CONTROLLER

(75) Inventors: Masayasu Ushida, Okazaki (JP); Kinya Takahashi, Obu (JP); Takao Nojiri, Anjo (JP); Seiji Yaoko, Anjo (JP); Jun Yamada, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 1055 days.

(21) Appl. No.: 11/783,002

(22) Filed: Apr. 5, 2007

(65) Prior Publication Data

US 2010/0251980 A1 Oct. 7, 2010

(30) Foreign Application Priority Data

Apr. 28, 2006 (JP) ..... 2006-125048
Dec. 21, 2006 (JP) ..... 2006-344047

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | |
|---|---|---|---|
| 6,763,791 | B2 | 7/2004 | Gardner et al. |
| 2005/0066923 | A1 | 3/2005 | Yaoko et al. |
| 2005/0284433 | A1 | 12/2005 | Yaoko et al. |
| 2007/0107684 | A1 | 5/2007 | Takahashi |

FOREIGN PATENT DOCUMENTS

| | | |
|---|---|---|
| JP | 2000-213310 | 8/2000 |
| JP | 2001-227310 | 8/2001 |
| JP | 2006046315 A * | 2/2006 |

OTHER PUBLICATIONS

Japanese Office Action dated Jul. 1, 2010, issued in corresponding Japanese Application No. 2006-344047, with English translation.
Co-pending U.S. Appl. No. 11/854,156, filed Sep. 12, 2007.
Co-pending U.S. Appl. No. 11/854,337, filed Sep. 12, 2007.
Co-pending U.S. Appl. No. 11/854,249, filed Sep. 12, 2007.

* cited by examiner

*Primary Examiner* — Zelalem Eshete
(74) *Attorney, Agent, or Firm* — Nixon & Vanderhye PC

(57) ABSTRACT

A first one-way valve is provided in a first advance passage connecting a hydraulic pump to a control advance chamber. A second one-way valve is provided in a first retard passage connecting the hydraulic pump to a control retard chamber. A first control valve is provided in a second advance passage to bypass the first one-way valve for communication of the first advance passage. A second control valve is provided in a second retard passage to bypass the second one-way valve for communication of the first retard passage. The first control valve operates by the pilot pressure to close the second advance passage at advance controlling and opening it at retard controlling. The second control valve operates by the pilot pressure to close the second retard passage at retard controlling and open it at advance controlling.

11 Claims, 20 Drawing Sheets

VALVE TIMING CONTROLLER

CROSS REFERENCE TO RELATED APPLICATION

This application is based on Japanese Patent Applications No. 2006-125048 filed on Apr. 28, 2006, and No. 2006-344047 filed on Dec. 21, 2006, the disclosures of which are incorporated herein by reference.

FIELD OF THE INVENTION

The present invention relates to a valve timing controller which changes opening/closing timing (hereinafter referred to as "valve timing") of at least one of an intake valve and an exhaust valve for an internal combustion engine (hereinafter referred to as "engine").

BACKGROUND OF THE INVENTION

There is conventionally known a valve timing controller which includes a housing receiving a drive force of a crankshaft for an engine and a vane rotor which is accommodated in the housing to transmit the drive force of the crankshaft to a camshaft, where the vane rotor is relatively rotated in a retard side or an advance side to the housing by pressure of an operating fluid in a retard chamber or an advance chamber, controlling a phase of the camshaft relative to the crankshaft, i.e., valve timing (for example, refer to US-2005/0284433 A1).

In such a valve timing controller, a torque fluctuation the camshaft receives from an intake valve or an exhaust valve when the intake valve or the exhaust valve is driven for opening/closing is transmitted to the vane rotor. As a result, the vane rotor is subject to the torque fluctuation to the retard side or the advance side relative to the housing.

In a case of supplying an operating fluid to the advance chamber to change a phase of the camshaft relative to the crankshaft from the retard side to a target phase of the advance side, the operating fluid in the advance chamber receives force in such a manner as to be flown out from the advance chamber, caused by that the vane rotor is subject to the torque fluctuation to the retard side. As a result, the vane rotor moves back to the retard side by the torque fluctuation as shown in a broken line of FIG. 20, increasing a response time until the vane rotor reaches the target phase. This phenomenon is significant when the pressure of the operating fluid from a fluid supply source is low.

Therefore, it is considered that a one-way valve is disposed in a supply passage for supplying the operating fluid to the advance chamber, preventing the operating fluid from flowing out from the advance chamber even if the vane rotor is subject to the torque fluctuation. As a result, it is known that this, as shown in a solid line of FIG. 20, prevents the vane rotor from returning back to a direction opposite to the target phase with respect to the housing during phase controlling, enhancing responsiveness of the phase control.

However, at the time of holding the vane rotor at the target phase, the operating fluid in the retard chamber is discharged from the retard chamber, caused by that the vane rotor receives the torque fluctuation to the advance side, so that the vane rotor tends to relatively rotate in the advance side to the housing. As a result, particularly when the supply pressure is low, the valve timing is more likely to be shifted to the advance side.

In view of the above, there exists a need for a valve timing controller which overcomes the above mentioned problems in the conventional art. The present invention addresses this need in the conventional art as well as other needs, which will become apparent to those skilled in the art from this disclosure.

SUMMARY OF THE INVENTION

It is an object of the present invention to provide a valve timing controller which enhances responsiveness in phase control of a vane rotor to a housing and also restricts shift of valve timing of an intake valve or an exhaust valve at the time of holding the vane rotor at a target phase.

A valve timing controller in an aspect of the present invention is provided with a first one-way valve provided in a first advance passage for connecting a fluid supply source to an advance chamber to permit flow of an operating fluid from the fluid supply source to the advance chamber and restrict flow of the operating fluid from the advance chamber to a side of the fluid supply source. As a result, even if the vane rotor receives the torque fluctuation to the retard side during advance controlling in the phase control, the discharge of the operating fluid from the advance chamber is prevented. This prevents the vane rotor from returning back to the direction opposite to the target phase relative to the housing during advance controlling and allows enhancement of responsiveness in phase control of the vane rotor relative to the housing.

Similarly, even if the vane rotor receives the torque fluctuation to the advance side during retard controlling in the phase control, since a second one-way valve is provided in a first retard passage, the discharge of the operating fluid from the retard chamber is prevented. This prevents the vane rotor from returning back to the direction opposite to the target phase relative to the housing during retard controlling and allows enhancement of responsiveness in phase control of the vane rotor relative to the housing.

In addition, a valve timing controller in an aspect of the present invention is provided with a second one-way valve provided in a first retard passage for connecting a fluid supply source to a retard chamber to permit flow of an operating fluid from the fluid supply source to the retard chamber and restrict flow of the operating fluid from the retard chamber to a side of the fluid supply source. As a result, even if the vane rotor receives the torque fluctuation to the advance side at the time of holding the vane rotor at the target phase, the discharge of the operating fluid from the retard chamber is prevented. This prevents the vane rotor from relatively rotating to the advance side, restricting shift of the valve timing of an intake valve or an exhaust valve.

Similarly, even if the vane rotor receives the torque fluctuation to the retard side at the time of holding the vane rotor at the target phase, since the first one-way valve is provided in the first advance passage, the discharge of the operating fluid from the advance chamber is prevented. This prevents the vane rotor from relatively rotating in the retard side, restricting shift of the valve timing of an intake valve or an exhaust valve.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION OF EMBODIMENTS

A plurality of embodiments in the present invention will be hereinafter described with reference to the accompanying drawings.

First Embodiment

A valve timing controller in a first embodiment of the present invention is shown in FIGS. 1 to 7D. A valve timing controller 1 in the first embodiment is of a hydraulic control type using an operating oil as an operating fluid and controls valve timing of an intake valve.

Figure 2:
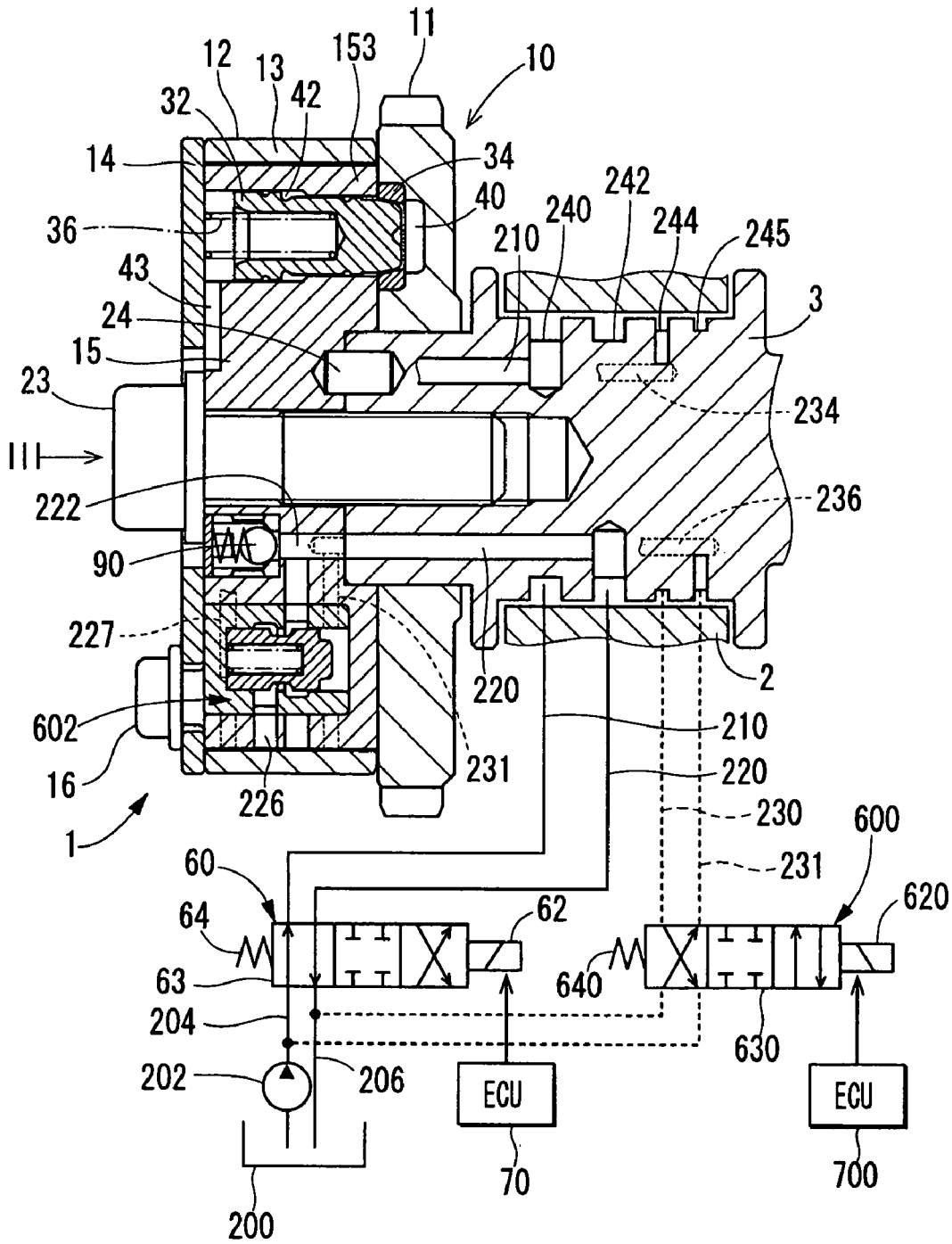
FIG. 2 is a longitudinal cross section showing the valve timing controller in the first embodiment.

As shown FIG. 2, a housing 10 as a drive rotational element is composed of a chain sprocket 11, a shoe housing 12 and a front plate 14. The shoe housing 12 includes shoes 121, 122 and 123 (refer to FIG. 3) as partition members and a circular peripheral wall 13. The front plate 14 is disposed at the opposite side to the chain sprocket 11 in such a manner as to put the peripheral wall 13 therebetween and is fixed coaxially with the chain sprocket 11 and the shoe housing 12 by bolts 16. The chain sprocket 11 is connected to a crankshaft as a drive shaft of an engine (not shown) by a chain (not shown), so that drive force is transmitted to the chain sprocket 11, which rotates in synchronization with the crankshaft.

The drive force of the crankshaft is transmitted through the valve timing controller 1 to a camshaft 3 as a driven shaft, which opens/closes an intake valve (not shown). The camshaft 3 is rotatably inserted into the chain sprocket 11, as having a predetermined phase difference from the chain sprocket 11.

The vane rotor 15 as a driven rotational element is in contact with an end face in the rotation axis direction of the camshaft 3, and the camshaft 3 and the vane rotor 15 are coaxially by bolts 23. The positioning in the rotational direction of the vane rotor 15 and the camshaft 3 is made by fitting a positioning pin 24 into the vane rotor 15 and the camshaft 3. The camshaft 3, the housing 10, and the vane rotor 15 rotate in the clockwise direction viewed from an arrow III in FIG. 2. This rotational direction will be hereinafter set as an advance direction of the camshaft 3 relative to the crankshaft.

Figure 3:
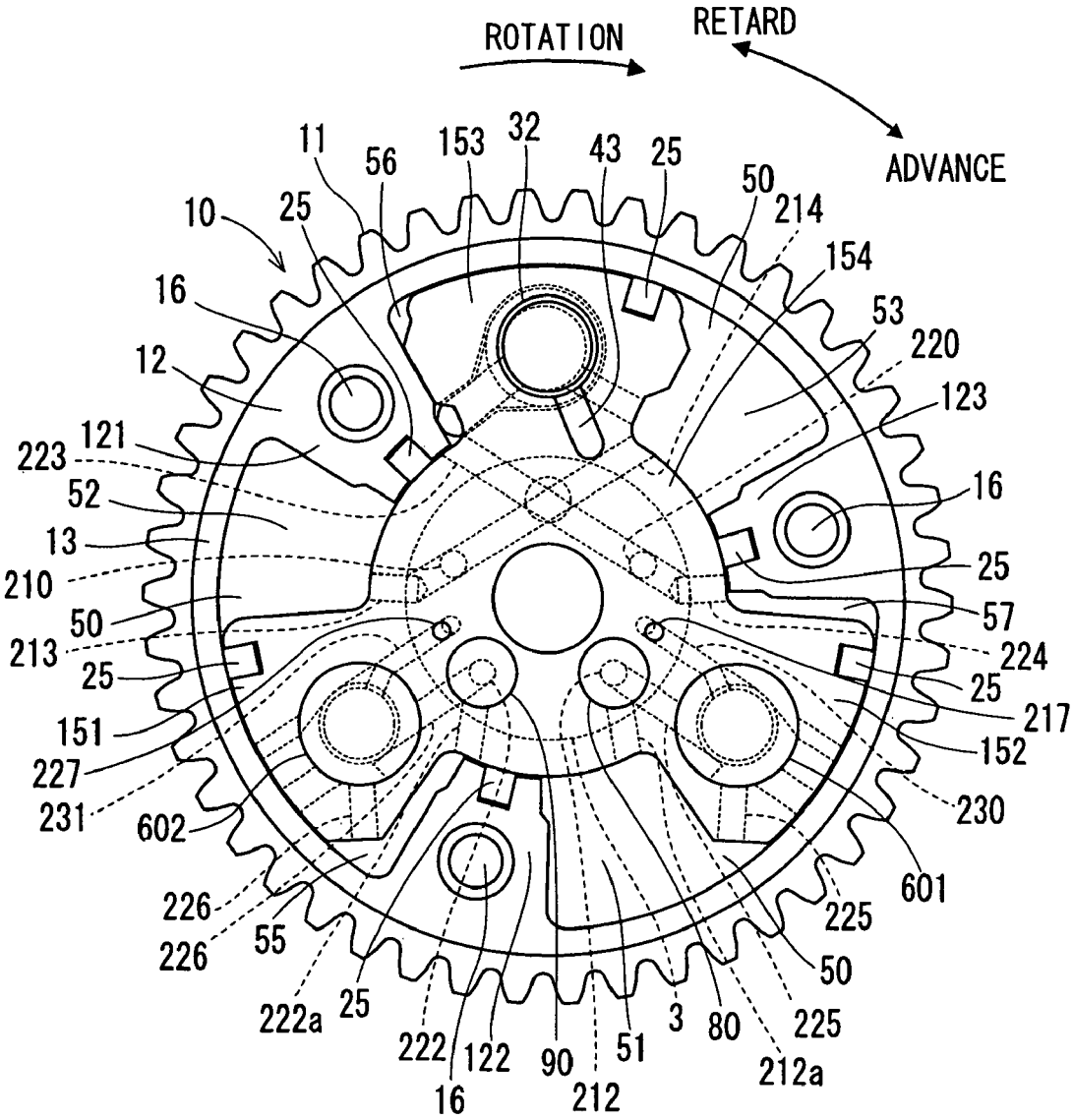
FIG. 3 is a schematic diagram viewed from an arrow III in FIG. 2 with a front plate being removed.

As shown in FIG. 3, the shoes 121, 122 and 123 respectively formed in a trapezoidal shape extend from the peripheral wall 13 to the inside of the radial direction and are arranged by substantially equal intervals in the rotational direction of the peripheral wall 13. A space is formed at three locations within a predetermined angular range in the rotational direction by the shoes 121, 122 and 123. Three fan-shaped accommodation chambers 50, which accommodate vanes 151, 152, and 153 respectively, are formed in the three spaces respectively.

Figure 1:
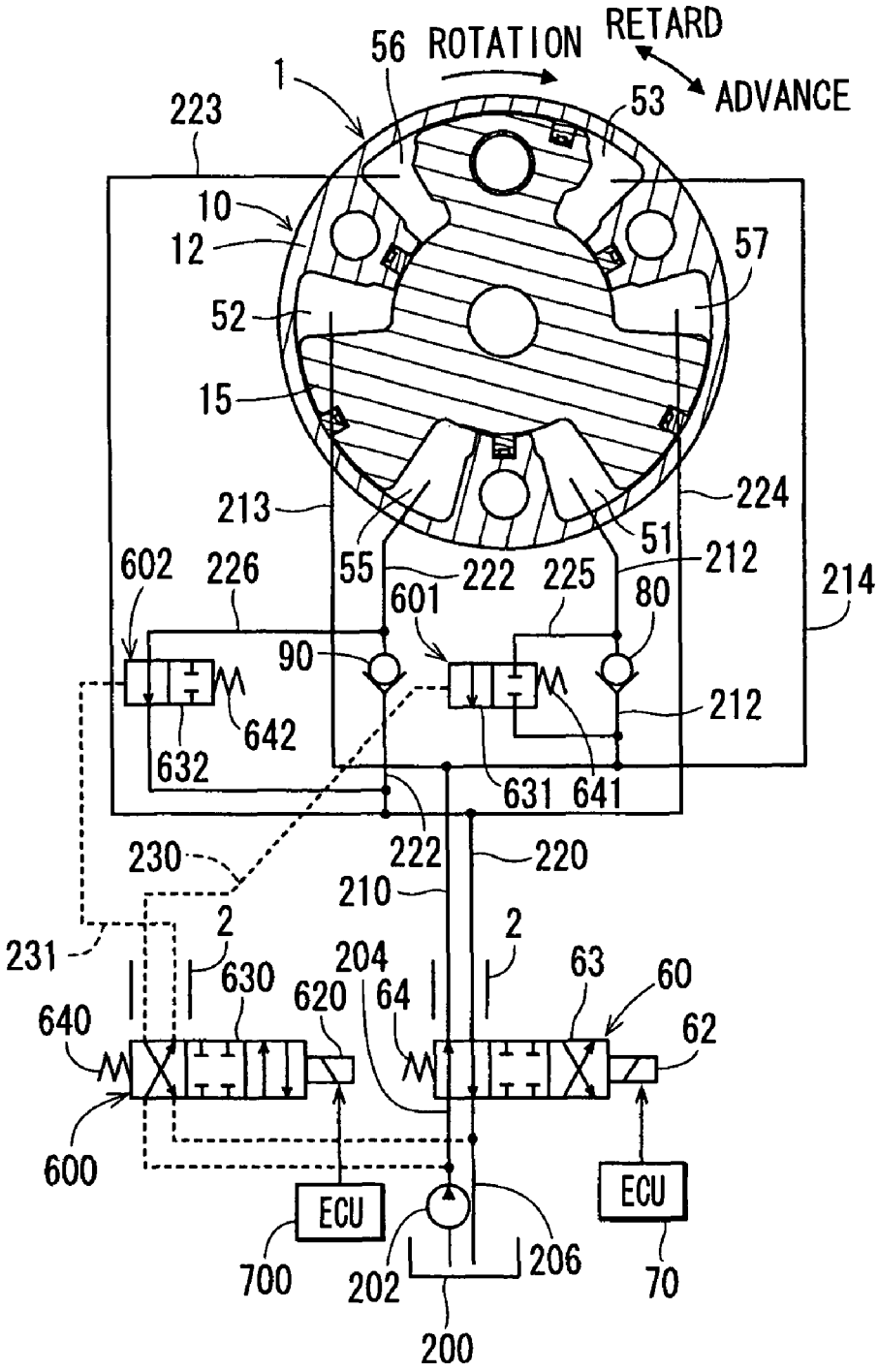
FIG. 1 is a schematic diagram showing a state at retard operating time of a valve timing controller in a first embodiment of the present invention.

The vane rotor 15 includes a boss portion 154 connected to the end face in the axial direction of the camshaft 3 and the vanes 151, 152 and 152 disposed in the outer peripheral side of the boss portion 154 by substantially equal intervals in the rotational direction. The vane rotor 15 is accommodated in the housing 10 and rotates relatively thereto. The vanes 151, 152, and 153 are rotatably accommodated in the respective accommodation chambers 50. Each vane partitions each accommodation chamber 50 to divide each accommodation chamber 50 into two chambers which are a retard chamber and an advance chamber. Each arrow illustrating a retard direction and an advance direction shown in FIG. 1 shows respectively a retard direction and an advance direction of the vane rotor 15 to the housing 10.

A seal member 25 is disposed in a sliding clearance formed between each shoe and the boss portion 154 radially facing each other and between each vane and an inner peripheral wall of the peripheral wall 13. The seal member 25 is fitted into a groove formed on the inner peripheral wall of each shoe and a groove formed in an outer peripheral wall of each vane and is urged toward the outer peripheral wall of the boss portion 154 and the inner peripheral wall of the peripheral wall 13 by a spring or the like. Due to this structure, the seal member 25 prevents the operating oil from leaking into each other between each retard chamber and each advance chamber.

As shown in FIG. 2, a stopper piston 32 formed in a cylindrical shape is slidably in the rotation axis direction in a through hole formed in the vane 153. A fitting ring 34 is press-fitted into a concave portion formed in the chain sprocket 11. The stopper piston 32 can be fitted into the fitting ring 34. Each fitting side between the stopper piston 32 and the fitting ring 34 is formed in a stopper shape and therefore, the stopper piston 32 and the fitting ring 34 are smoothly fitted. A spring 36 as urging means urges the stopper piston 32 toward the side of the fitting ring 34. The stopper piston 32, the fitting ring 34 and the spring 36 constitute restricting means, which restricts relative rotation of the vane rotor 15 to the housing 10.

Pressures of the operating oil supplied to a hydraulic chamber 40 formed in the side of the chain sprocket 11 of the stopper piston 32 and a hydraulic chamber 42 formed in the outer periphery of the stopper piston 32 act in such a direction that the stopper piston 32 comes out of the fitting ring 34. The hydraulic chamber 40 is in communication with either one of advance chambers and the hydraulic chamber 42 is in communication with either one of retard chambers, which will be described later. The stopper piston 32 has a tip portion, which is fitted into the fitting ring 34 when the vane rotor 15 is positioned at the maximum retard position to the housing 10. The relative rotation of the vane rotor 15 to the housing 10 is restricted in a state where the stopper piston 32 is fitted into the fitting ring 34. It should be noted that a backpressure-relief groove 43 for relieving the backpressure fluctuating with the sliding of the stopper piston 32 is formed in a portion of the vane rotor 15 at the opposition side to the fitting ring 34 to put the stopper piston 32 in between.

When the vane rotor 15 rotates from the maximum retard position toward the advance side relative to the housing 10, the stopper piston 32 is deviated in position from the fitting ring 34 in the rotational direction, thereby making it impossible for the stopper piston 32 to be fitted into the fitting ring 34.

As shown in FIG. 3, a retard chamber 52 is formed between the shoe 121 and the vane 151, a retard chamber 51 is formed between the shoe 122 and the vane 152 and a retard chamber 53 is formed between the shoe 123 and the vane 153. In addition, an advance chamber 57 is formed between the shoe 123 and the vane 152, an advance chamber 55 is formed between the shoe 122 and the vane 151 and an advance chamber 56 is formed between the shoe 121 and the vane 153.

A hydraulic pump 202 as a fluid supply source supplies an operating oil sucked up from an oil pan 200 to a supply passage 204. An advance/retard-switching valve 60 is a known electromagnetic spool valve and is disposed in the side of the hydraulic pump 202 of a bearing 2. The advance/retard-switching valve 60 is controlled and switched by duty ratio-controlled drive current supplied from an electronically controlled unit (ECU) 70 to an electromagnetic drive section 62 of the advance/retard-switching valve 60. A spool 63 of the advance/retard-switching valve 60 moves based upon a duty ratio of the drive current. The position of the spool 63 causes the advance/retard-switching valve 60 to switch supply of an operating oil to each retard chamber and each advance chamber and discharge of the operating oil from each retard chamber and each advance chamber. The spool 63 is positioned as shown in FIG. 1 by the urging force of a spring 64 in a state where the power supply to the advance/retard-switching valve 60 is not made.

As shown in FIG. 2, circular passages 240, 242 244 and 245 are formed on the outer peripheral wall of the camshaft 3 rotatably supported by the bearing 2. A retard passage 210 goes from the advance/retard-switching valve 60 through the circular passage 240 and is formed in the camshaft 3 and the boss portion 154 of the vane rotor 15 and an advance passage 220 goes from the advance/retard-switching valve 60 through the circular passage 242 and is formed in the camshaft 3 and the boss portion 154 of the vane rotor 15.

As shown in FIG. 1, the retard passage 210 is branched into the retard passages 212, 213 and 214 as first retard passages connected to the retard chambers 51, 52 and 53 respectively. The retard passages 210, 212, 213 and 214 supply an operating oil from the supply passage 204 and the advance/retard-switching valve 60 to the respective retard chambers 51, 52 and 53 and also discharge an operating oil through the advance/retard-switching valve 60 and a discharge passage 206 from respective advance chambers 55, 56 and 57 to the side of the oil pan 200 as the fluid discharge side. Therefore, the retard passages 210, 212, 213 and 214 serve as retard supply passages and retard discharge passages.

The advance passage 220 is branched into advance passages 222, 223 and 224 as first advance passages connected to the advance chambers 55, 56 and 57 respectively. The advance passages 220, 222, 223 and 224 supply an operating oil from the supply passage 204 and the advance/retard-switching valve 60 to the respective advance chambers 55, 56 and 57 and also discharge an operating oil through the advance/retard-switching valve 60 and the discharge passage 206 from the respective advance chambers 55, 56 and 57 to the side of the oil pan 200 as the fluid discharge side. Therefore, the advance passages 220, 222, 223 and 224 serve as advance supply passages and advance discharge passages.

According to the above passage arrangement, the operating oil is supplied from the hydraulic pump 202 to the retard chambers 51, 52 and 53, the advance chambers 55, 56 and 57, and the hydraulic chambers 40 and 42. In addition, the operating oil is discharged from each hydraulic chamber to the oil pan 200.

A first one-way valve 90 is provided in the advance passage 222 among the advance passages 222, 223 and 224 connected to the advance chambers 55, 56 and 57. The first one-way valve 90 is disposed at a position closer to the advance chamber 55 of the advance passage 222 than the bearing 2. The first one-way valve 90 allows an operating oil to flow into the advance chamber 55 from the hydraulic pump 202 through the advance passage 222 and prohibits the operating oil to reversely flow to the side of the hydraulic pump 202 from the advance chamber 55 through the advance passage 222. It should be noted that the advance chamber 55 connected to the advance passage 222 provided with the first one-way valve 90 may be referred to as "control advance chamber 55" hereinafter.

A second one-way valve 80 is provided in the retard passage 212 among the retard passages 212, 213 and 214 connected to the retard chambers 51, 52 and 53. The second one-way valve 80 is disposed at a position closer to the retard chamber 51 of the retard passage 212 than the bearing 2. The second one-way valve 80 allows an operating oil to flow into the retard chamber 51 from the hydraulic pump 202 through the retard passage 212 and prohibits the operating oil to reversely flow to the side of the hydraulic pump 202 from the retard chamber 51 through the retard passage 212. It should be noted that the retard chamber 51 connected to the retard passage 212 provided with the second one-way valve 80 may be referred to as "control retard chamber 51" hereinafter.

Figure 6A:
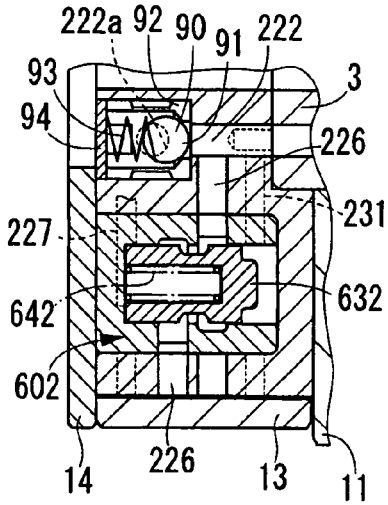
FIGS. 6A to 6D each are a cross section showing operations of a first one-way valve and a first control valve in the first embodiment.
Figure 7A:
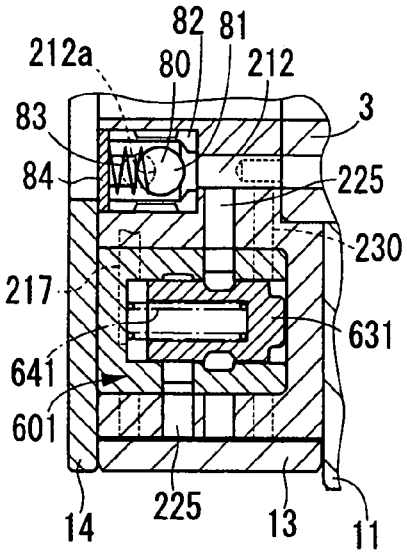
FIGS. 7A to 7D each are a cross section showing operations of a second one-way valve and a second control valve in the first embodiment.

As shown in FIGS. 6A and 7A, the second one-way valve 80 and the first one-way valve 90 are respectively provided with valve bodies 81 and 91, valve seats 82 and 92, springs 83 and 93, and stoppers 84 and 94. The springs 83 and 93 are respectively arranged between the stoppers 84 and 94 and the valve bodies 81 and 91, urging the valve bodies 81 and 91 in the direction of being pushed on the valve seats 82 and 92.

According to this arrangement, when an operating oil is supplied from the hydraulic pump 202 to the control advance chamber 55 and the control retard chamber 51, the valve bodies 81 and 91 moves toward the stoppers 84 and 94 against the urging force of the springs 83 and 93 to leave away from the valve seats 82 and 92, thus opening the advance passage 222 and the retard passage 212. Then, the operating oil in the advance passage 222 flows into the control advance chamber 55 through a supply exclusive oil passage 222*a* of the advance passage 222 (refer to FIGS. 3, 6 and 7) for connecting the first one-way valve 90 to the control advance chamber 55. In addition, the operating oil in the retard passage 212 flows into the control retard chamber 51 through a supply exclusive oil passage 212*a* of the retard passage 212 (refer to FIGS. 3, 6 and 7) for connecting the second one-way valve 80 to the control retard chamber 51.

On the other hand, even if the operating oil tends to flow from the control advance chamber 55 and the control retard chamber 51 toward the hydraulic pump 202, the springs 83 and 93 cause the valve bodies 81 and 91 to be pushed on the valve seats 82 and 92, thereby closing the advance passage 222 and the retard passage 212.

A second advance passage 226 is connected to the advance passage 222 in such a manner as to bypass the first one-way valve 90 for communication. The second advance passage 226 is provided with a first control valve 602 therein which closes the second advance passage 226 at the time of performing advance control for relatively rotating the vane rotor 15 to the advance side and opens the second advance passage 226 at the time of performing retard control for relatively rotating the vane rotor 15 to the retard side. When the second advance passage 226 is opened, the operating oil in the control advance chamber 55 is discharged through the second advance passage 226 and the advance passage 222 (refer to FIGS. 3 and 6). That is, the second advance passage 226 serves as an oil passage exclusive for discharge.

The first control valve 602 is a switch valve which operates by a pilot pressure, which is supplied through an advance pilot passage 231 from the hydraulic pump 202. In a state where the pilot pressure is supplied to the first control valve 602, a spool 632 is positioned as shown in FIG. 1 against an urging force of a spring 642 as a first resilient member. The advance pilot passage 231 is connected to the position closer to the hydraulic pump 202 than the advance/retard-switching valve 60.

A second retard passage 225 is connected to the retard passage 212 in such a manner as to bypass the second one-way valve 80 for communication. The second retard passage 225 is provided with a second control valve 601 therein which closes the second retard passage 225 at the time of performing retard control for relatively rotating the vane rotor 15 to the retard side and opens the second retard passage 225 at the time of performing advance control for relatively rotating the vane rotor 15 to the advance side. When the second retard passage 225 is opened, the operating oil in the control retard chamber 51 is discharged through the second retard passage 225 and the retard passage 212 (refer to FIGS. 3 and 7). That is, the second retard passage 225 serves as an oil passage exclusive for discharge.

The second control valve 601 is a switch valve which operates by a pilot pressure, which is supplied through a retard pilot passage 230 from the hydraulic pump 202. In a state where the pilot pressure is not supplied to the second control valve 601, a spool 631 is positioned as shown in FIG. 1 by an urging force of a spring 641 as a second resilient member. The retard pilot passage 230 is connected to the position closer to the hydraulic pump 202 than the advance/retard-switching valve 60.

Both of the springs 641 and 642 urge both of the spools 631 and 632 toward the position of closing the second retard passage 225 and the second advance passage 226. Therefore, in a state where the control valves 601 and 602 are not operating by the pilot pressure, the second retard passage 225 and the second advance passage 226 normally close. That is, the first control valve 602 and the second control valve 601 in the first embodiment are a so-called normally closed type control valve. Backpressure release passages 217 and 227 for releasing the backpressure fluctuating caused by the sliding of the spools 631 and 632 are formed in portions of the vane rotor 15 in the sides of the springs 641 and 642 urging the spools 631 and 632 of the control valves 601 and 602.

A drain switch valve 600 is disposed in the advance pilot passage 231 and the retard pilot passage 230 for switching supply and non-supply of the pilot pressure. The drain switch valve 600 is controlled to be switched by the duty-ratio-controlled drive current supplied from an electrically controlled unit (ECU) 700 to an electromagnetic drive section 620. The spool 630 of the drain switch valve 600 moves based upon a duty ratio of the drive current. Depending on the position of the spool 630, the drain switch valve 600 switches supply of pilot oil to the first control valve 602 and the second control valve 601 and discharge of the pilot oil from the first control valve 602 and the second control valve 601. In a state where power supply to the drain switch valve 600 is OFF, the spool 630 is positioned as shown in FIG. 1 by the urging force of the spring 640.

As shown in FIG. 2, the first one-way valve 90 and the first control valve 602 are housed in the vane rotor 15. In addition, the second one-way valve 80 and the second control valve 60 are also, although the illustration is omitted in FIG. 2, housed in the vane rotor 15 with the mounting structure similar to that of the first one-way valve 90 and the first control valve 602. The advance pilot passage 231 and the retard pilot passage 230 go from the drain switch valve 600 through the circular passages 245 and 244, and are formed in the camshaft 3 and the boss portion 154 of the vane rotor 15.

Figure 4:
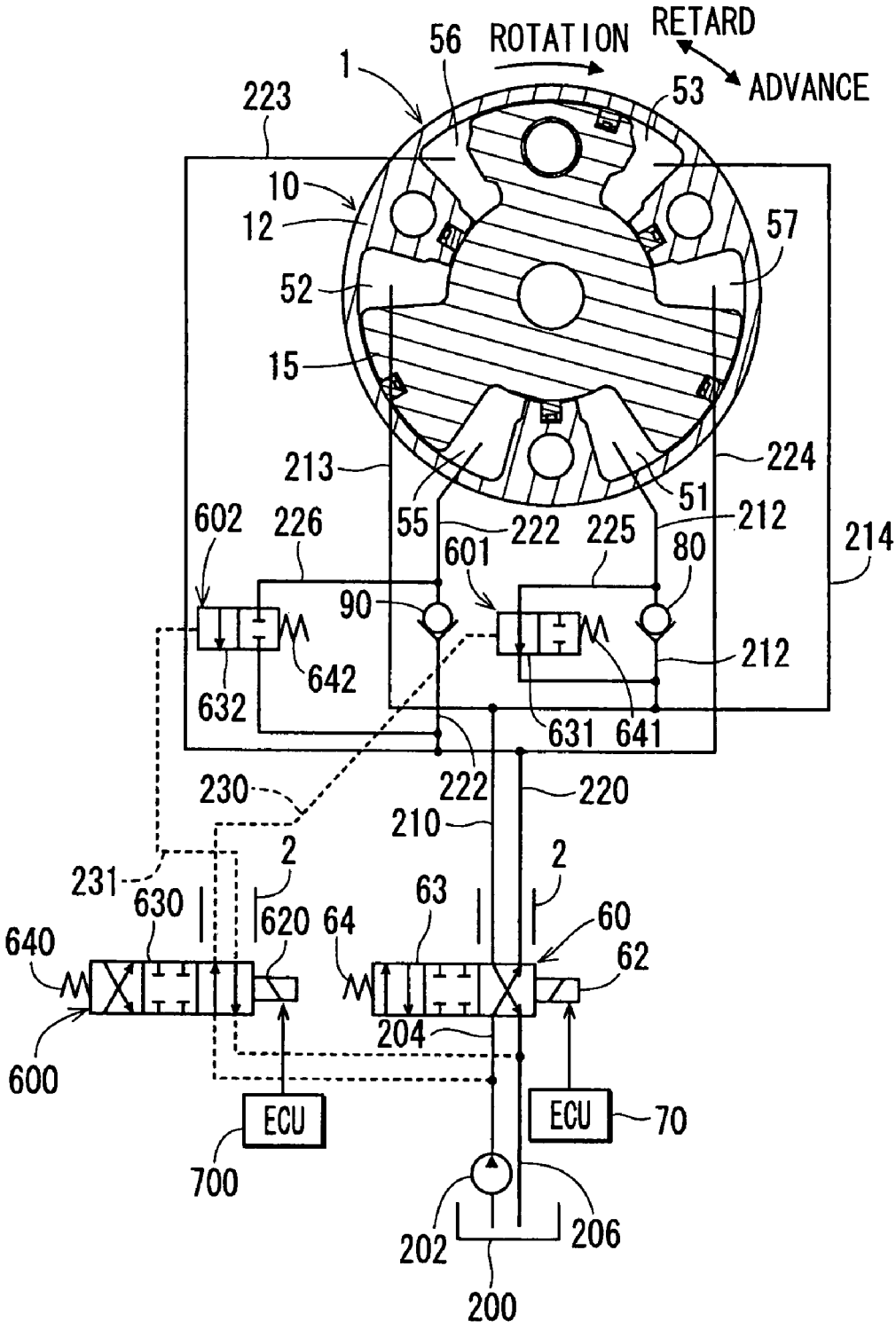
FIG. 4 is a schematic diagram showing a state at advance operating time of the valve timing controller in the first embodiment.
Figure 5:
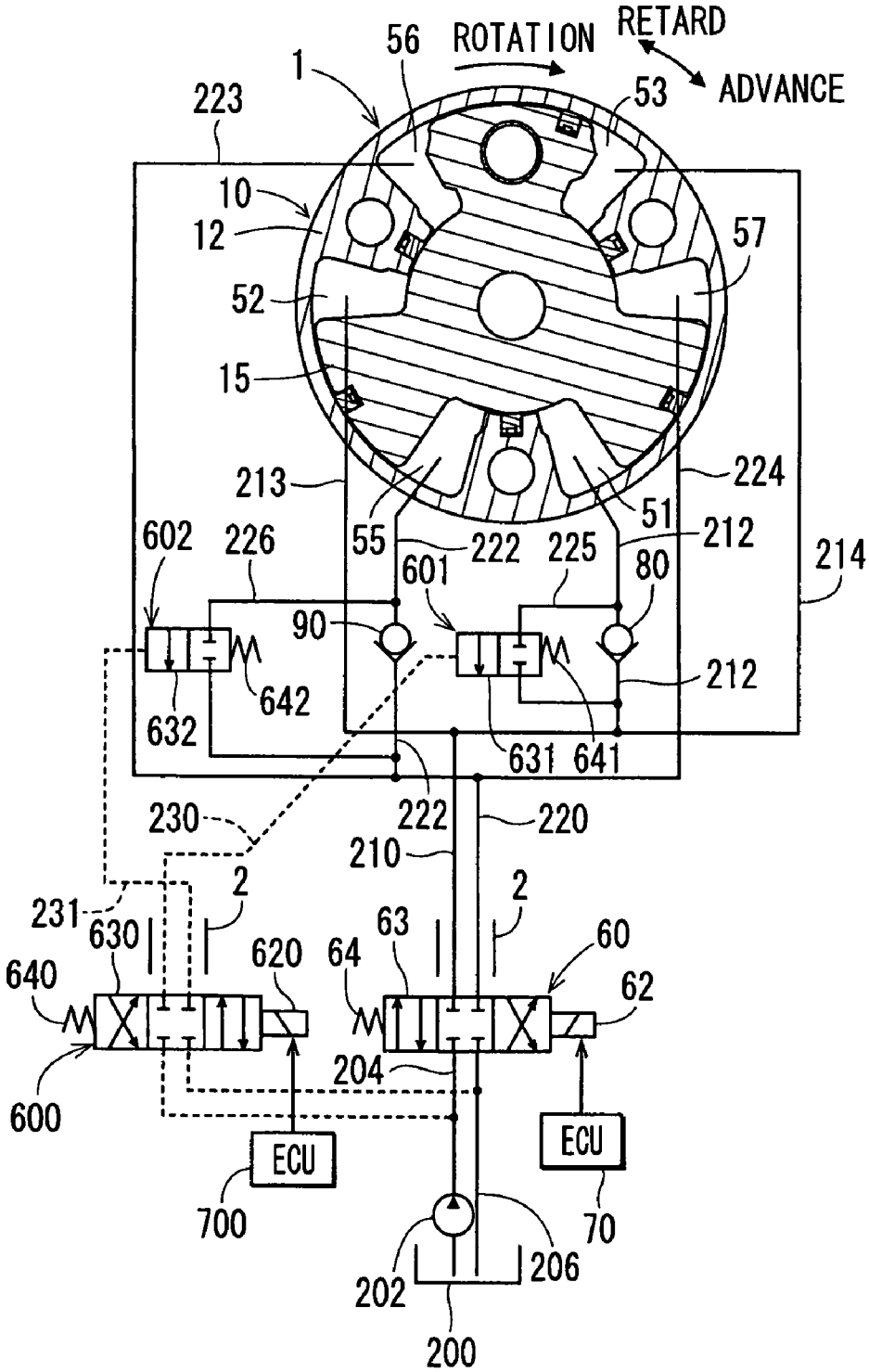
FIG. 5 is a schematic diagram showing a state at intermediate hold operating time of the valve timing controller in the first embodiment.

Next, operations of the vane rotor 15 and the advance/retard-switching valve 60 in the valve timing controller 1 will be described with reference to FIGS. 1, 4 and 5. FIG. 1 shows a state where the vane rotor 15 is moving in the retard direction relative to the housing 10. FIG. 4 shows a state where the vane rotor 15 is moving in the advance direction relative to the housing 10. FIG. 5 shows a state where the vane rotor 15 is held not to relatively rotate to the housing 10.

[At Engine Stop Time]

The stopper piston 32 is fitted into the fitting ring 34 at engine stop. Since in a condition immediate after the engine startup, an operating oil is not sufficiently supplied from the hydraulic pump 202 to the retard chambers 51, 52 and 53, the advance chambers 55, 56 and 57 and the hydraulic chambers 40 and 42, the stopper piston 32 remains to be fitted into the fitting ring 34 and the camshaft 3 is held at the maximum retard position to the crankshaft. This prevents that, for a period until the operating oil is supplied to each hydraulic chamber, the housing 10 and the vane rotor 15 swing and collide with each other due to the torque fluctuation the camshaft receives, generating slapping sounds.

[After Engine Startup]

When the operating oil is sufficiently supplied from the hydraulic pump 202 after engine startup, the hydraulic pressure of the operating oil supplied to the hydraulic chamber 40 or the hydraulic chamber 42 causes the stopper piston 32 to come out of the fitting ring 34, so that the vane rotor 15 relatively rotates to the housing 10. In addition, the hydraulic pressure applied to each retard chamber and each advance chamber is controlled to adjust the phase difference of the camshaft to the crankshaft.

[At Retard Operating Time]

In a state where power supply to the advance/retard-switching valve 60 is OFF as shown in FIG. 1, the spool 63 is positioned as shown in FIG. 1 by the urging force of the spring 64. In this state, the operating oil is supplied from the supply passage 204 to the retard passage 210 and goes through the retard passages 213 and 214 to be led to the retard chambers 52 and 53. Then, the operating oil goes through the retard passage 212 and is supplied to the retard chamber 51 through the second one-way valve 80.

In this state, the operating oil in the advance chambers 56 and 57 goes through the advance passages 223 and 224, the advance passage 220, the advance/retard-switching valve 60 and the discharge passage 206 in that order and is discharged to the oil pan 200. The operating oil in the control advance chamber 55, since the first one-way valve 90 is disposed in the advance passage 222, goes through the second advance passage 226, the first control valve 602, the advance passage 220 and the advance/retard-switching valve 60 and then is discharged to the oil pan 200.

The operating oil is thus supplied to each retard chamber and is discharged from each advance chamber, and thereby the vane rotor 15 is subject to the operating hydraulic pressure from the three retard chambers 51, 52 and 53. As a result, the vane rotor 15 rotates at the retard side relative to the housing 10.

When, as shown in FIG. 1, the operating oil is supplied to each retard chamber and is discharged from each advance chamber to perform phase control (retard control) of moving the vane rotor 15 to a target phase in the retard side, the torque fluctuation the camshaft receives causes the vane rotor 15 to receive the torque fluctuation in the retard side and the advance side to the housing 10. When the vane rotor 15 receives the torque fluctuation in the advance side, the operating oil in each retard chamber receives the force in such a manner as to flow out into the retard passages 212, 213 and 214.

However, since in the first embodiment, the second one-way valve 80 is disposed in the retard passage 212, the operating oil does not flow out from the control retard chamber 51 to the side of the retard passage 212. Accordingly, when the hydraulic pressure in the hydraulic pump 202 is low, even if the vane rotor 15 receives the torque fluctuation in the advance side, the vane rotor is not to be back to the advance side relative to the housing 10. As a result, the operating oil does not flow out from the retard chambers 52 and 53, either. Therefore, even if the vane rotor 15 receives the torque fluctuation in the advance side from the camshaft, it is prevented that the vane rotor 15 returns back to the advance side opposite to the target phase. Therefore, the vane rotor 15 quickly reaches the target phase in the retard side.

[At Advance Operating Time]

Next, when power supply to the advance/retard-switching valve 60 is ON, the spool 63 is positioned as shown in FIG. 4 by the electromagnetic force of the electromagnetic drive section 62 applied against the urging force of the spring 64. In this state, the operating oil is supplied from the supply passage 204 to the advance passage 220 and goes through the advance passages 223 and 224 to be led to the advance chambers 56 and 57. Then, the operating oil goes through the advance passage 222 and is supplied to the advance chamber 55 through the first one-way valve 90.

In this state, the operating oil in the retard chambers 52 and 53 goes from the retard passages 213 and 214 through the retard passage 210, the advance/retard-switching valve 60 and the discharge passage 206 and is discharged to the oil pan 200. The operating oil in the control retard chamber 51, since the second one-way valve 80 is disposed in the retard passage 212, goes through the second retard passage 225, the second control valve 601, the retard passage 210 and the advance/retard-switching valve 60 and then is discharged to the oil pan 200.

The operating oil is thus supplied to each advance chamber and is discharged from each retard chamber, and thereby the vane rotor 15 is subject to the operating hydraulic pressure from the three advance chambers 55, 56 and 57. As a result, the vane rotor 15 rotates toward the advance side relative to the housing 10.

When, as shown in FIG. 4, the operating oil is supplied to each advance chamber and is discharged from each retard chamber to perform phase control (advance control) of moving the vane rotor 15 to a target phase in the advance side, the torque fluctuation the camshaft receives causes the vane rotor 15 to receive the torque fluctuation in the retard side and the advance side to the housing 10. When the vane rotor 15 receives the torque fluctuation in the retard side, the operating oil in each advance chamber receives the force in such a manner as to flow out into the advance passages 222, 223 and 224.

However, since in the first embodiment, the first one-way valve 90 is disposed in the advance passage 222, the operating oil does not flow out from the control advance chamber 55 to the side of the advance passage 222. Accordingly, when the hydraulic pressure in the hydraulic pump 202 is low, even if the vane rotor 15 receives the torque fluctuation in the retard side, the vane rotor is not to be back at the retard side to the housing 10. As a result, the operating oil does not flow out from the advance chambers 56 and 57, either. Therefore, even if the vane rotor 15 receives the torque fluctuation in the retard side from the camshaft, it is prevented that the vane rotor 15 returns back to the retard side opposite to the target phase. Therefore, the vane rotor 15 quickly reaches the target phase in the advance side.

[At Intermediate Hold Operating Time]

When the vane rotor 15 reaches the target phase, ECU 70 controls a duty ratio of drive current supplied to the advance/retard-switching valve 60 to hold the spool 63 at an intermediate position of FIG. 5. As a result, the advance/retard-switching valve 60 disconnects the retard passage 210 and the advance passage 220 respectively to the supply passage 204 and the discharge passage 206 to prevent the operating oil from being discharged from each advance chamber and each retard chamber to the oil pan 200. Therefore, the vane rotor 15 is held at the target phase.

FIG. 5 schematically shows that supply of the operating oil from the supply passage 204 to the retard passage 210 and the advance passage 220 is supposed to be completely closed. However, in fact the closing amount of the operating oil is regulated by adjustment of the position of the spool 63 in the advance/retard-switching valve 60 and therefore, in a condition shown in FIG. 5, the operating oil from the supply passage 204 to the retard passage 210 and the advance passage 220 is slightly supplied. As a result, the vane rotor 15 is held at the target phase by balance of a pressure difference between the retard passage 210 and the advance passage 220 and average load torque of the camshaft 3.

Next, operations of the first one-way valve 90 and the second one-way valve 80 and the first control valve 602 and the second control valve 601 at the retard operating time, the advance operating time and intermediate hold operating time as described above will be explained with reference to FIGS. 6A to 6D and 7A to 7D. FIGS. 6A to 6D show operations of the first one-way valve 90 and the first control valve 602, which are connected to the control advance chamber 55, and FIGS. 7A to 7D show operations of the second one-way valve 80 and the second control valve 601, which are connected to the control retard chamber 51.

[At Retard Operating Time]

As shown in FIG. 6A, in a case where the vane rotor 15 receives negative torque in the advance side or positive torque in the retard side at retard operating time, the first one-way valve 90 closes the advance passage 222 to prevent reverse flow of the operating oil from the supply exclusive oil passage 222*a* to the advance passage 222. In addition, the first control valve 602 opens the second advance passage 226 by the pilot pressure, making it possible for the operating oil in the control advance chamber 55 to flow out through the second advance passage 226.

On the other hand, as shown in FIG. 7A, in a case where the vane rotor 15 receives positive torque at retard operating time, the second one-way valve 80 opens the retard passage 212 to supply the operating oil from the retard passage 212 through the supply exclusive oil passage 212*a* to the control retard chamber 51. In addition, the second control valve 601 closes the second retard passage 225 by the spring 641, preventing the operating oil in the control retard chamber 51 from flowing out through the second retard passage 225.

Figure 7B:
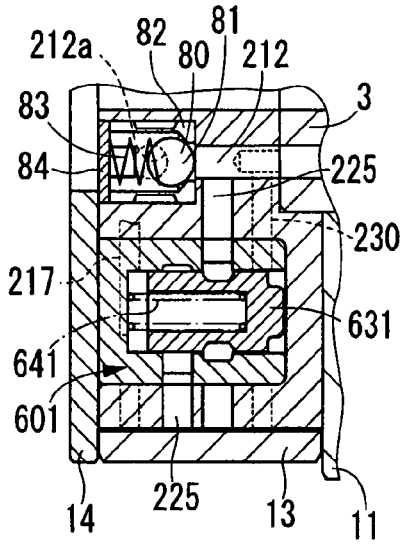

In addition, as shown in FIG. 7B, in a case where the vane rotor 15 receives negative torque at retard operating time, the second one-way valve 80 closes the retard passage 212 to prevent reverse flow of the operating oil from the supply exclusive passage 212*a* to the retard passage 212. In addition, the second control valve 601 closes the second retard passage 225 by the spring 641, preventing the operating oil in the control retard chamber 51 from flowing out through the second retard passage 225.

[At Advance Operating Time]

Figure 6B:
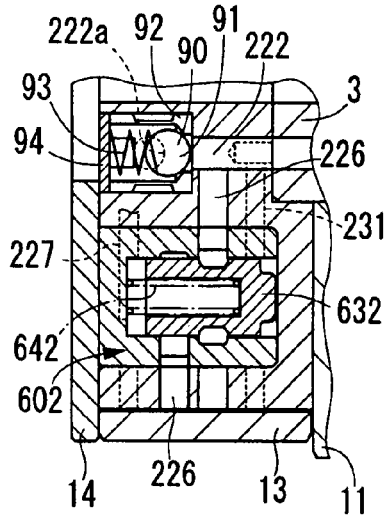

On the other hand, as shown in FIG. 6B, in a case where the vane rotor 15 receives positive torque at advance operating time, the first one-way valve 90 closes the advance passage 222 to prevent reverse flow of the operating oil from the supply exclusive oil passage 222*a* to the advance passage 222. In addition, the first control valve 602 closes the second advance passage 226 by the spring 642, preventing the operating oil in the control advance chamber 55 from flowing out through the second advance passage 226.

Figure 6C:
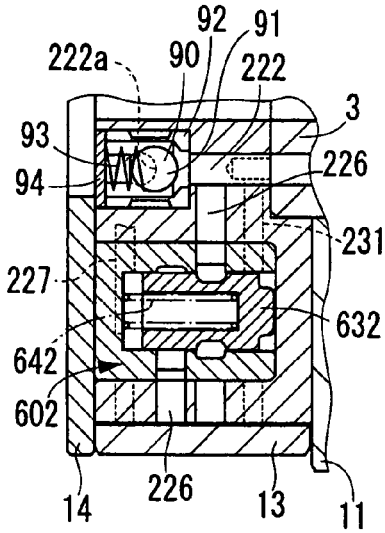

In addition, as shown in FIG. 6C, in a case where the vane rotor 15 receives negative torque at advance operating time, the first one-way valve 90 opens the advance passage 222 to supply the operating oil from the advance passage 222 through the supply exclusive oil passage 222*a* to the control advance chamber 55. In addition, the first control valve 602 closes the second advance passage 226 by the spring 642, preventing the operating oil in the control advance chamber 55 from flowing out through the second advance passage 226.

Figure 7C:
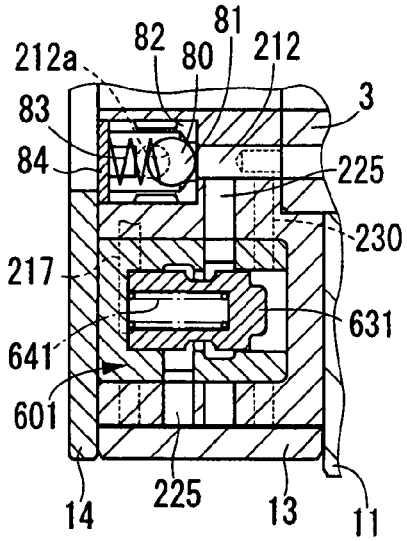

On the other hand, as shown in FIG. 7C, in a case where the vane rotor 15 receives positive torque or negative torque at advance operating time, the second one-way valve 80 closes the retard passage 212 to prevent reverse flow of the operating oil from the supply exclusive oil passage 212*a* to the retard passage 212. In addition, the second control valve 601 opens the second retard passage 225 by the pilot pressure, making it possible for the operating oil in the control retard chamber 51 to flow out through the second retard passage 225.

[At Intermediate Hold Operating Time]

Figure 6D:
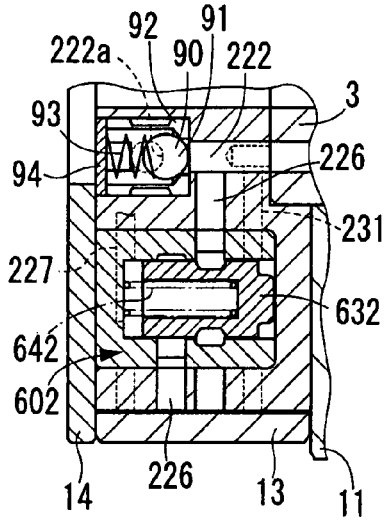

As shown in FIG. 6D, in a case where the vane rotor 15 receives positive torque or negative torque at intermediate hold operating time, the first one-way valve 90 closes the advance passage 222 to prevent reverse flow of the operating oil from the supply exclusive oil passage 222*a* to the advance passage 222. In addition, the first control valve 602 closes the second advance passage 226 by the spring 642, preventing the operating oil in the control advance chamber 55 from flowing out through the second advance passage 226.

Figure 7D:
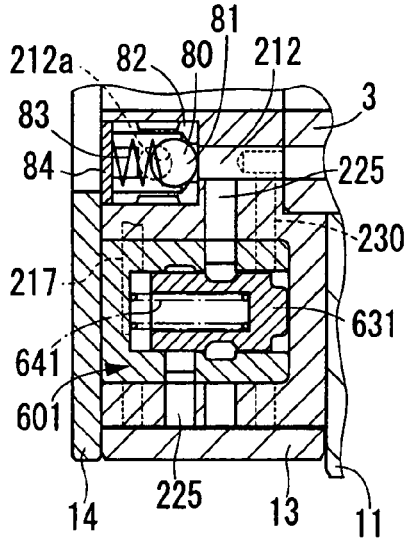

On the other hand, as shown in FIG. 7D, in a case where the vane rotor 15 receives positive torque or negative torque at intermediate hold operating time, the second one-way valve 80 closes the retard passage 212 to prevent reverse flow of the operating oil from the supply exclusive oil passage 212*a* to the retard passage 212. In addition, the second control valve 601 closes the second retard passage 225 by the spring 641, preventing the operating oil in the control retard chamber 51 from flowing out through the second retard passage 225.

As described above, since in the first embodiment, the second one-way valve 80 is disposed in the retard passage 212 and the second control valve 601 in the second retard passage 225 is closed, the operating oil does not flow out from the control retard chamber 51 to the side of the retard passage 212. Accordingly, even if the vane rotor 15 receives the torque fluctuation in the advance side at intermediate hold operating time when the vane rotor 15 is held in the target phase, it is prevented that the operating oil flows out from the control retard chamber 51. Therefore, even if the vane rotor 15 receives the torque fluctuation toward the advance side at intermediate hold operating time, the vane rotor 15 does not return back to the advance side relative to the housing 10. Therefore, the operating oil does not flow out from the retard chambers 52 and 53, either. Accordingly, it is prevented that the vane rotor 15 relatively rotates toward the advance side, making it possible to restrict deviation in valve timing of an intake valve.

Similarly, since the first one-way valve 90 is disposed in the advance passage 222 and the first control valve 602 in the second advance passage 226 is closed, the operating oil does not flow out from the control advance chamber 55 to the side of the advance passage 222 at intermediate hold operating time. Accordingly, even if the vane rotor 15 receives the torque fluctuation toward the retard side at intermediate hold operating time, it is prevented that the vane rotor 15 relatively rotates toward the retard side, making it possible to restrict deviation in valve timing of an intake valve.

In addition, according to the first embodiment, the pilot pressure is supplied from the hydraulic pump 202, which is remoter from the first control valve 602 and the second control valve 601 than the advance/retard-switching valve 60, to the first control valve 602 and the second control valve 601. As a result, even if the inner hydraulic pressure in each advance chamber and each retard chamber fluctuates, caused by that the vane rotor 15 receives torque fluctuation at advance/retard operating time, the sufficient oil passage distance causes the fluctuation of the hydraulic pressure to be damped, reducing the fluctuation of the pilot pressure. This ensures that the first control valve 602 and the second control valve 601 can be stably operated.

Second Embodiment

Figure 8:
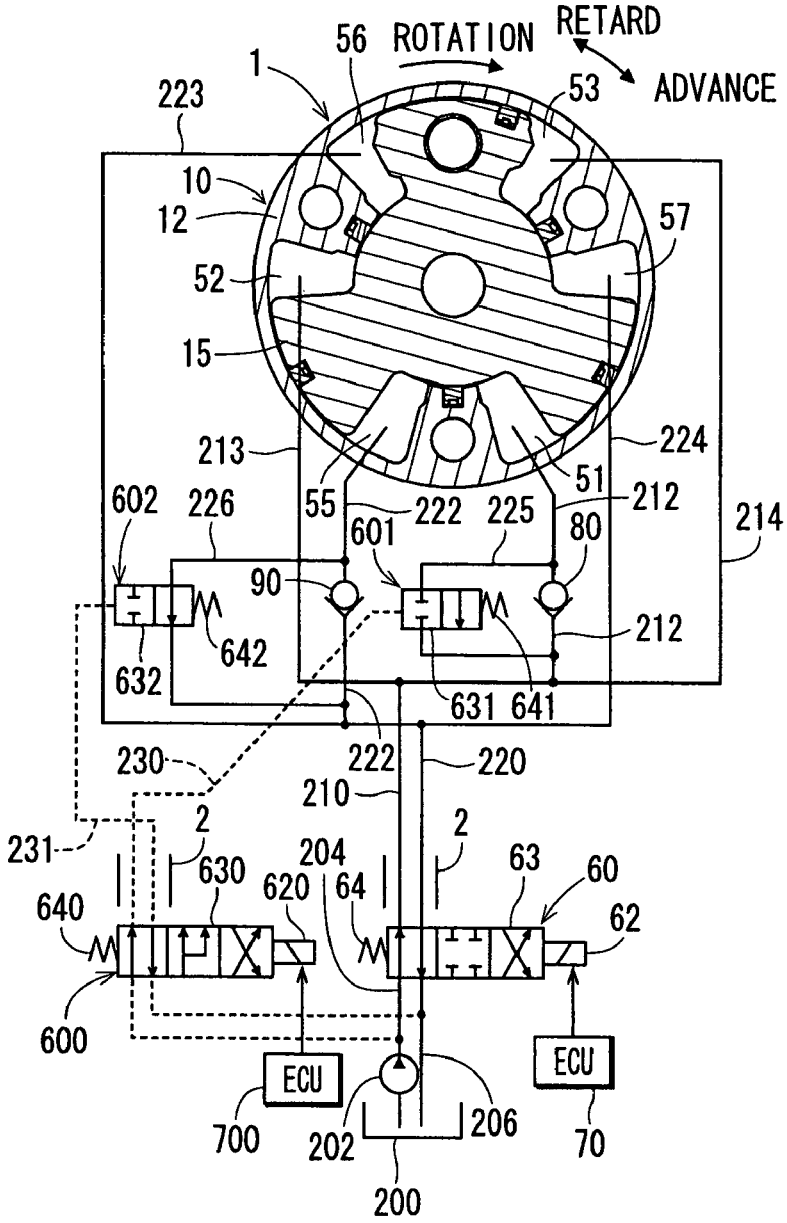
FIG. 8 is a schematic diagram showing a state at retard operating time of a valve timing controller in a second embodiment of the present invention.
Figure 9:
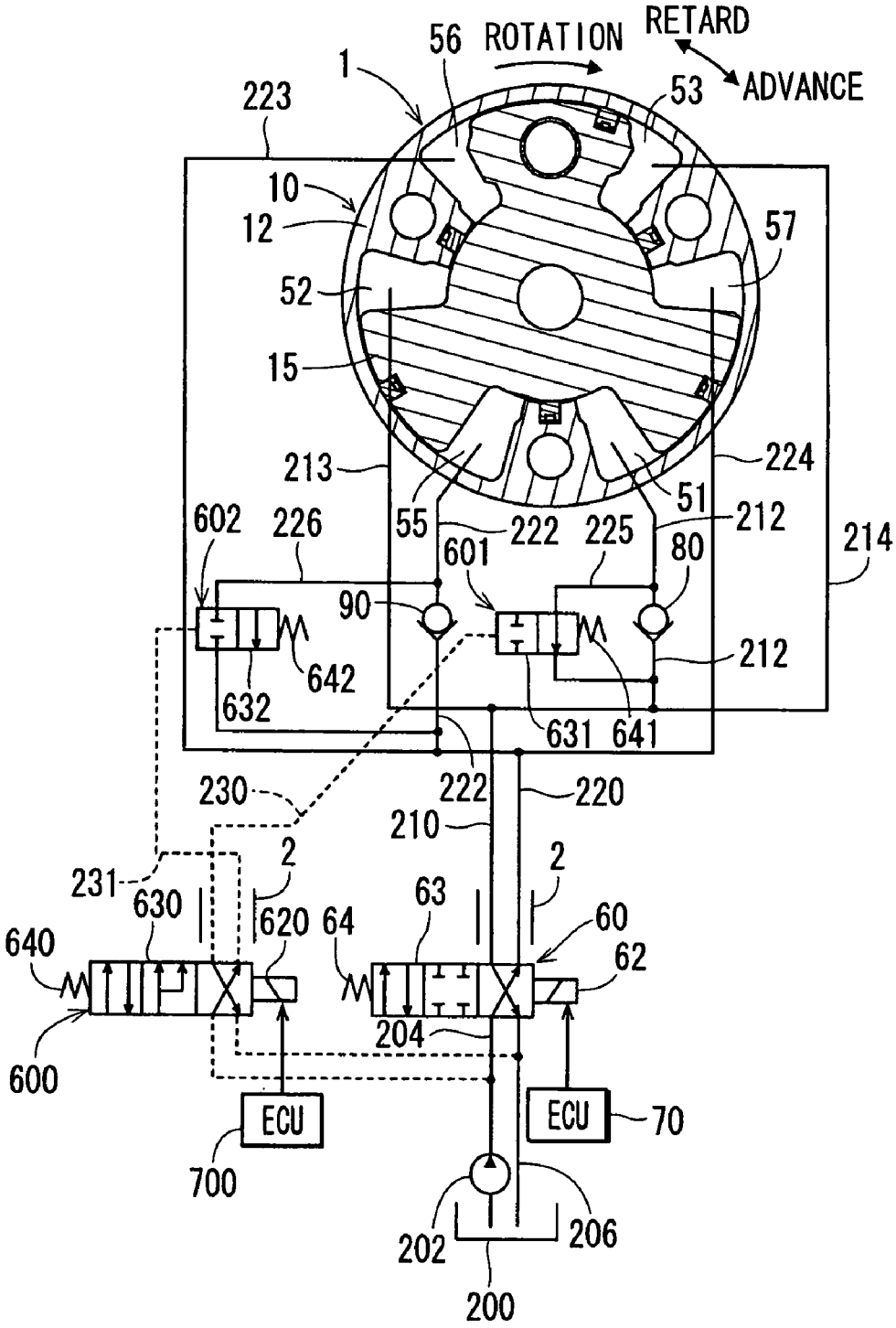
FIG. 9 is a schematic diagram showing a state at advance operating time of the valve timing controller in the second embodiment.
Figure 10:
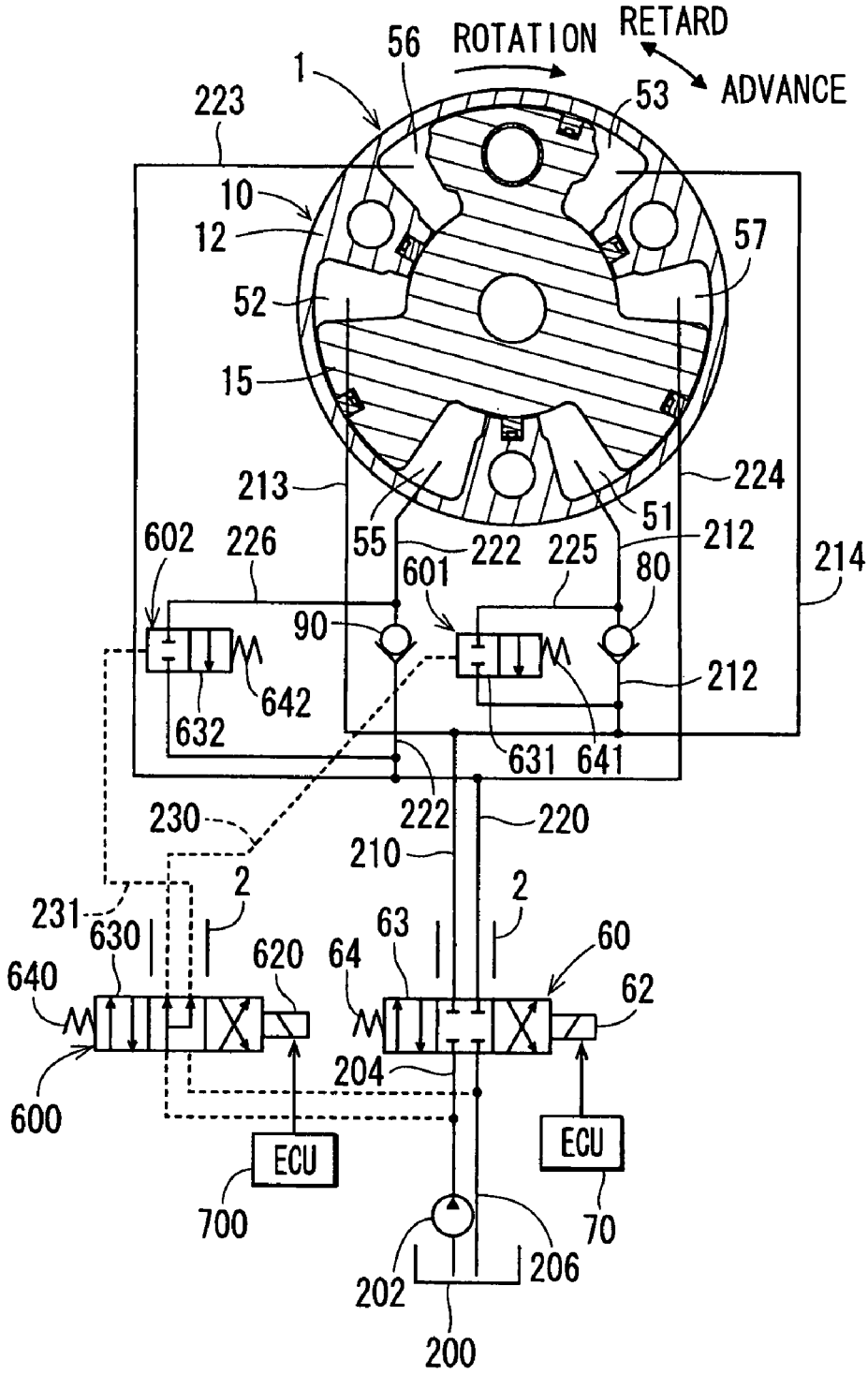
FIG. 10 is a schematic diagram showing a state at intermediate hold operating time of the valve timing controller in the second embodiment.

FIGS. 8 to 10 show a second embodiment in the present invention. It should be noted that components substantially identical to those in the first embodiment are referred to as identical numerals.

With respect to the first control valve 602 and the second control valve 601, a normally closed type control valve is adopted in the first embodiment and on the other hand, a normally open type control valve is adopted in the second embodiment as shown in FIGS. 8 to 10.

More specially, both of the springs 642 and 641 urge the first control valve 602 and the second control valve 601 toward the position of opening the second advance passage 226 and the second retard passage 225. Therefore, in a state where the control valves 601 and 602 are not operating by the pilot pressure, the second retard passage 225 and the second advance passage 226 normally open.

Accordingly, operations of the vane rotor 15, the advance/retard-switching valve 60, the first one-way valve 90, the second one-way valve 80, the first control valve 602 and the second control valve 601 are similar to that in the first embodiment shown in FIGS. 1, 4 and 5. They operate as shown in FIG. 8 at retard operating time, operate as shown in FIG. 9 at advance operating time and operate as shown in FIG. 10 at intermediate hold operating time.

An operation of supplying the pilot pressure in the second embodiment is, however, different in the following respect from the first embodiment.

That is, at retard operating time as shown in FIG. 8, the pilot pressure is not supplied to the first control valve 602 and is supplied to the second control valve 601 through the retard pilot passage 230. At advance operating time as shown in FIG. 9, the pilot pressure is supplied to the first control valve 602 through the advance pilot passage 231 and is not supplied to the second control valve 601. At intermediate hold operating time as shown in FIG. 10, the pilot pressure is supplied to the first control valve 602 and the second control valve 601 through the advance pilot passage 231 and the retard pilot passage 230.

Third Embodiment

Figure 11:
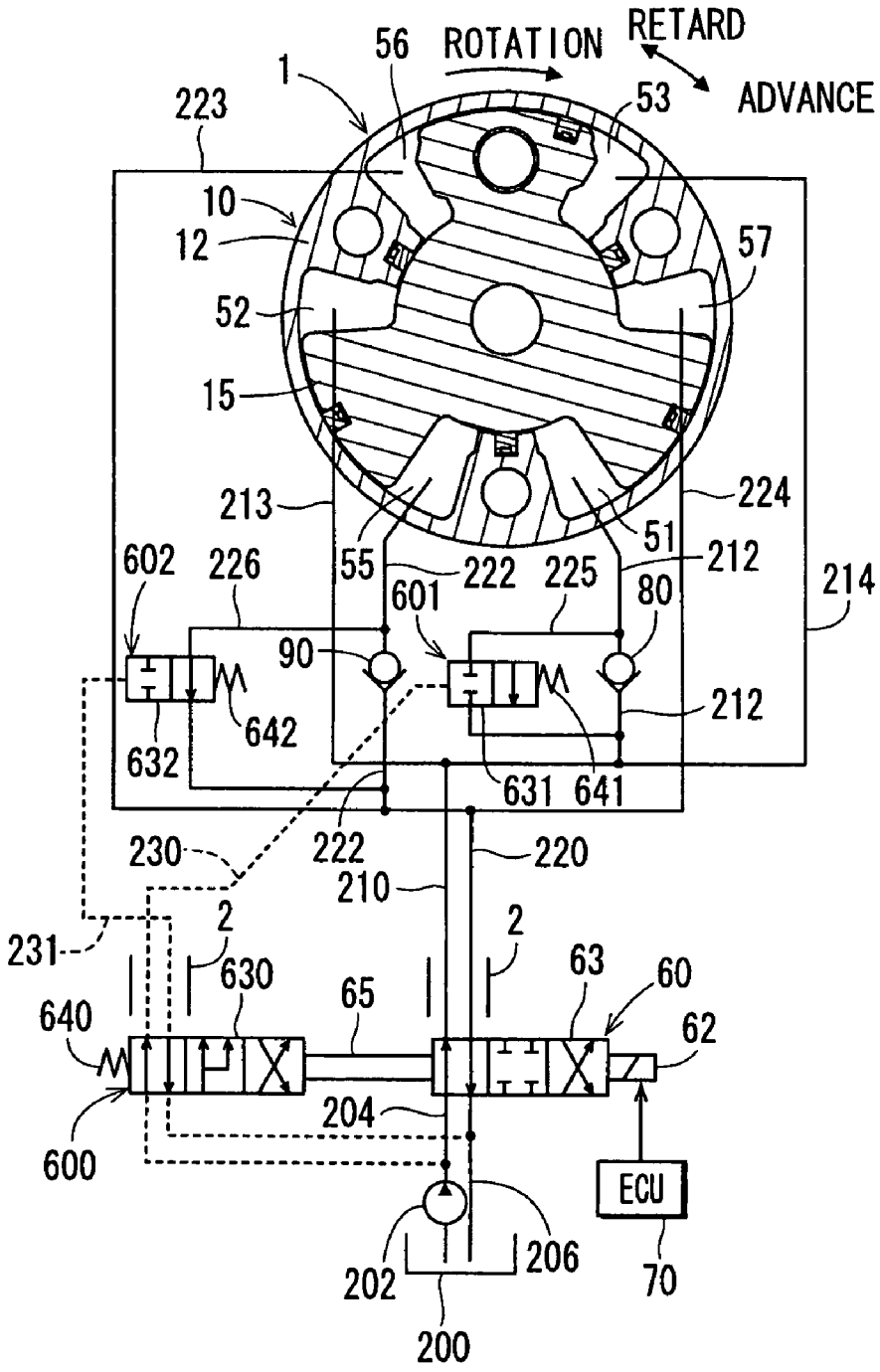
FIG. 11 is a schematic diagram showing a state at retard operating time of a valve timing controller in a third embodiment of the present invention.
Figure 12:
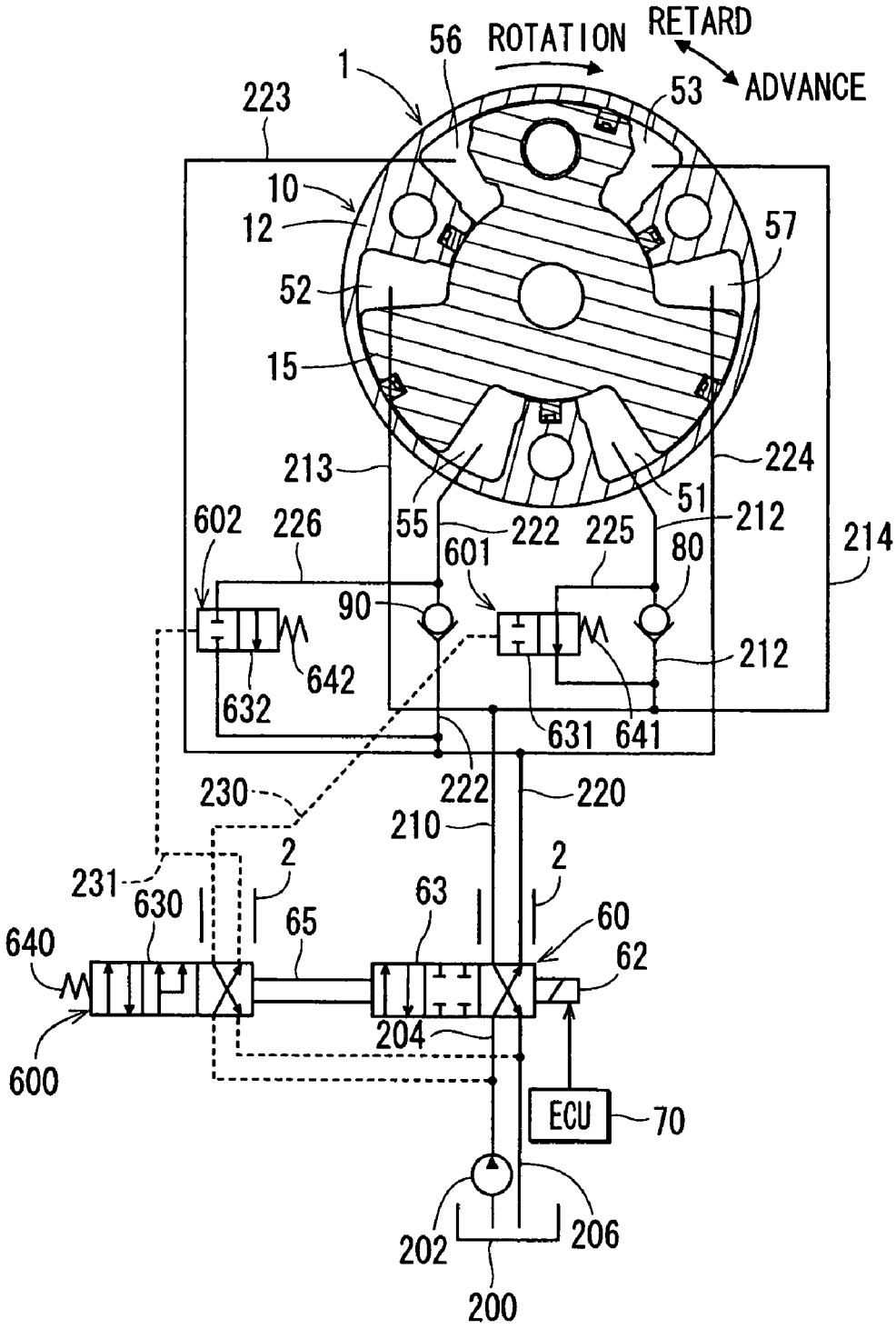
FIG. 12 is a schematic diagram showing a state at advance operating time of the valve timing controller in the third embodiment.
Figure 13:
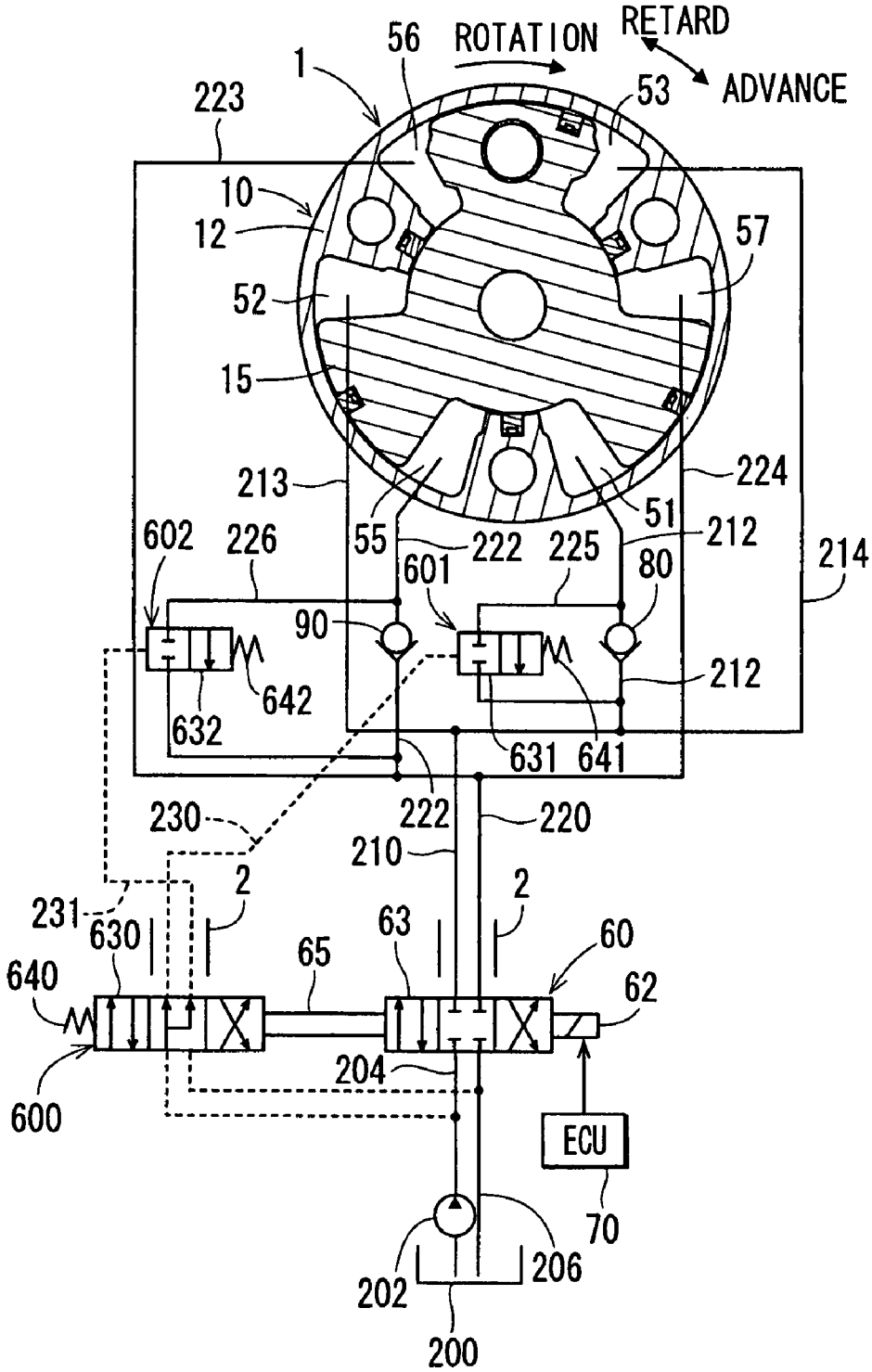
FIG. 13 is a schematic diagram showing a state at intermediate hold operating time of the valve timing controller in the third embodiment.

FIGS. 11 to 13 show a third embodiment in the present invention. It should be noted that components substantially identical to those in the first embodiment are referred to as identical numerals.

In the first embodiment described above, the operation of the advance/retard-switching valve 60 is controlled by FIG. 70 and the drain switch valve 600 is controlled by FIG. 700. Therefore, the operations of the switch valves 60 and 600 are controlled independently with each other. In contrast, in the third embodiment, as shown in FIGS. 11 to 13, the advance/retard-switching valve 60 and the drain switch valve 600 are connected in operation with each other, operations of which are controlled by a single FIG. 70.

More specially, the spring 64 of the advance/retard-switching valve 60, the electromagnetic drive section 620 of the drain switch valve 600 and FIG. 700 which are used in the first embodiment are abolished and the spool 63 of the advance/retard-switching valve 60 and the spool 630 of the drain switch valve 600 are connected by a connecting member 65. As a result, the control of the operations can be simplified as compared to the independent control respectively for the operations of both the switch valves 60 and 600.

Accordingly, operations of the vane rotor 15, the advance/retard-switching valve 60, the first one-way valve 90, the second one-way valve 80, the first control valve 602 and the second control valve 601 are similar to that in the first embodiment shown in FIGS. 1, 4 and 5. They operate as shown in FIG. 11 at retard operating time, operate as shown in FIG. 12 at advance operating time and operate as shown in FIG. 13 at intermediate hold operating time.

With respect to an operation of supplying the pilot pressure, the first control valve 602 and the second control valve 601 in the third embodiment adopt a normally open type control valve similar to that in the second embodiment. As a result, the operation of supplying the pilot pressure is similar to that in the second embodiment.

Fourth Embodiment

Figure 14:
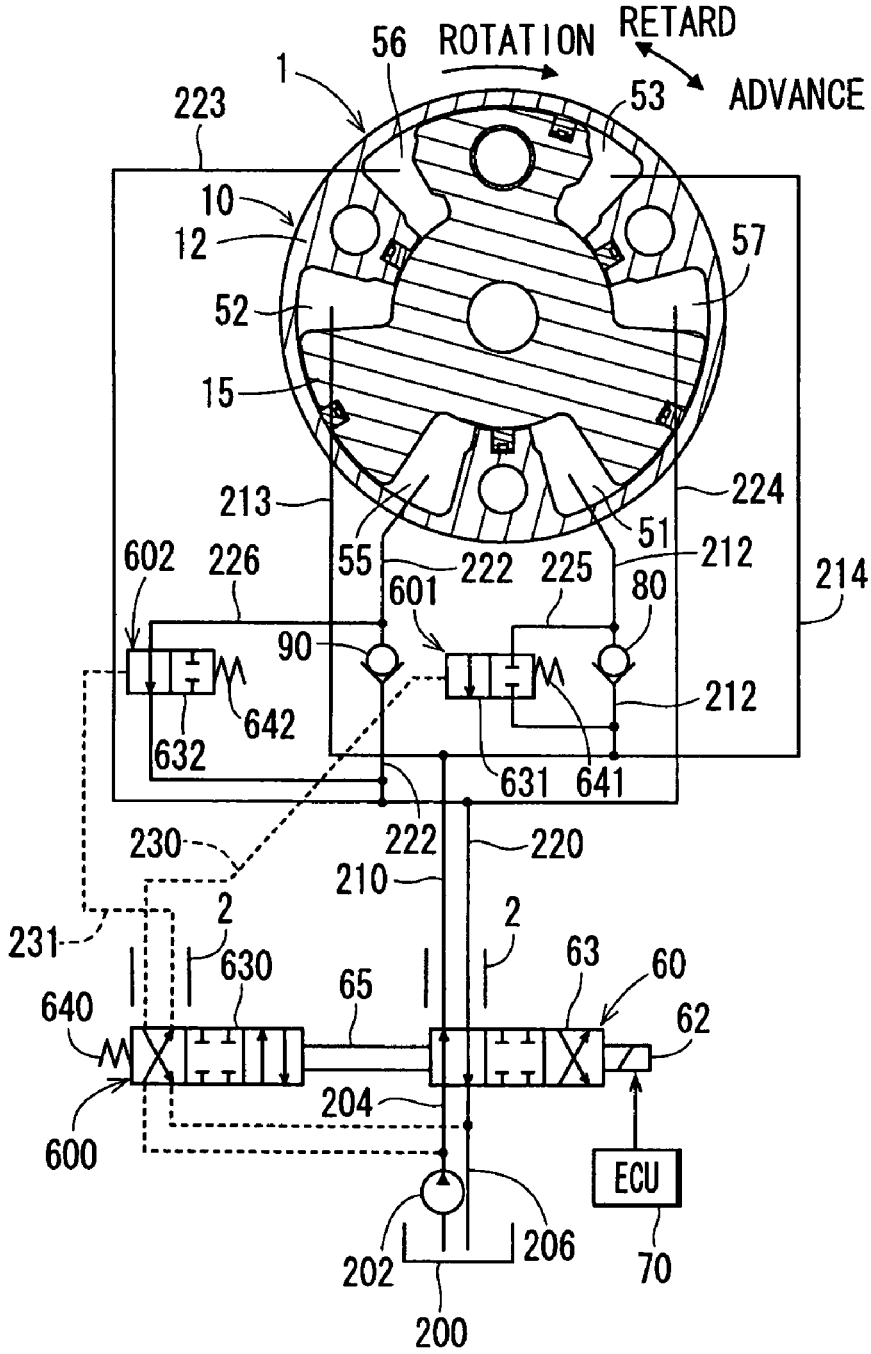
FIG. 14 is a schematic diagram showing a state at retard operating time of a valve timing controller in a fourth embodiment of the present invention.
Figure 15:
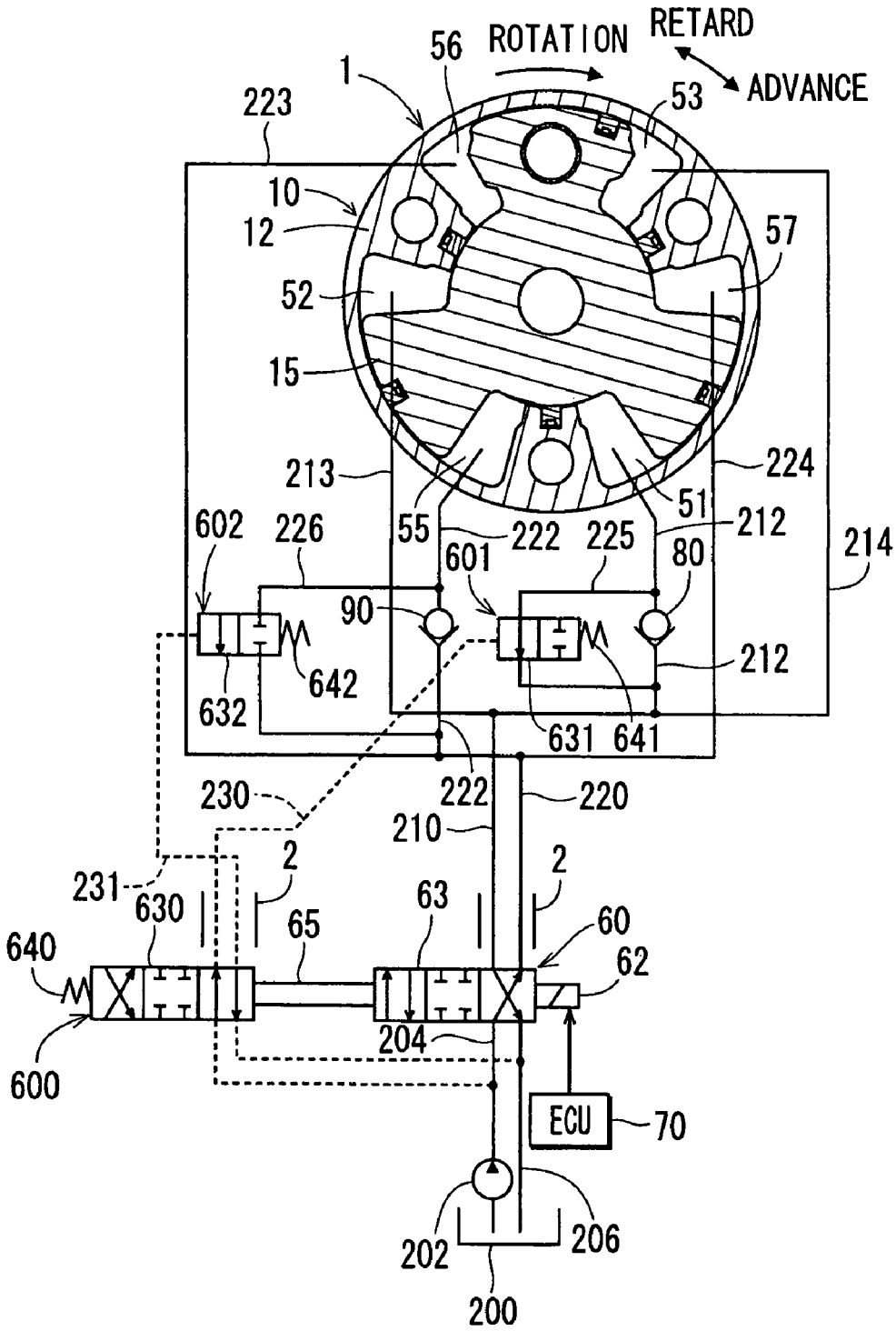
FIG. 15 is a schematic diagram showing a state at advance operating time of the valve timing controller in the fourth embodiment.
Figure 16:
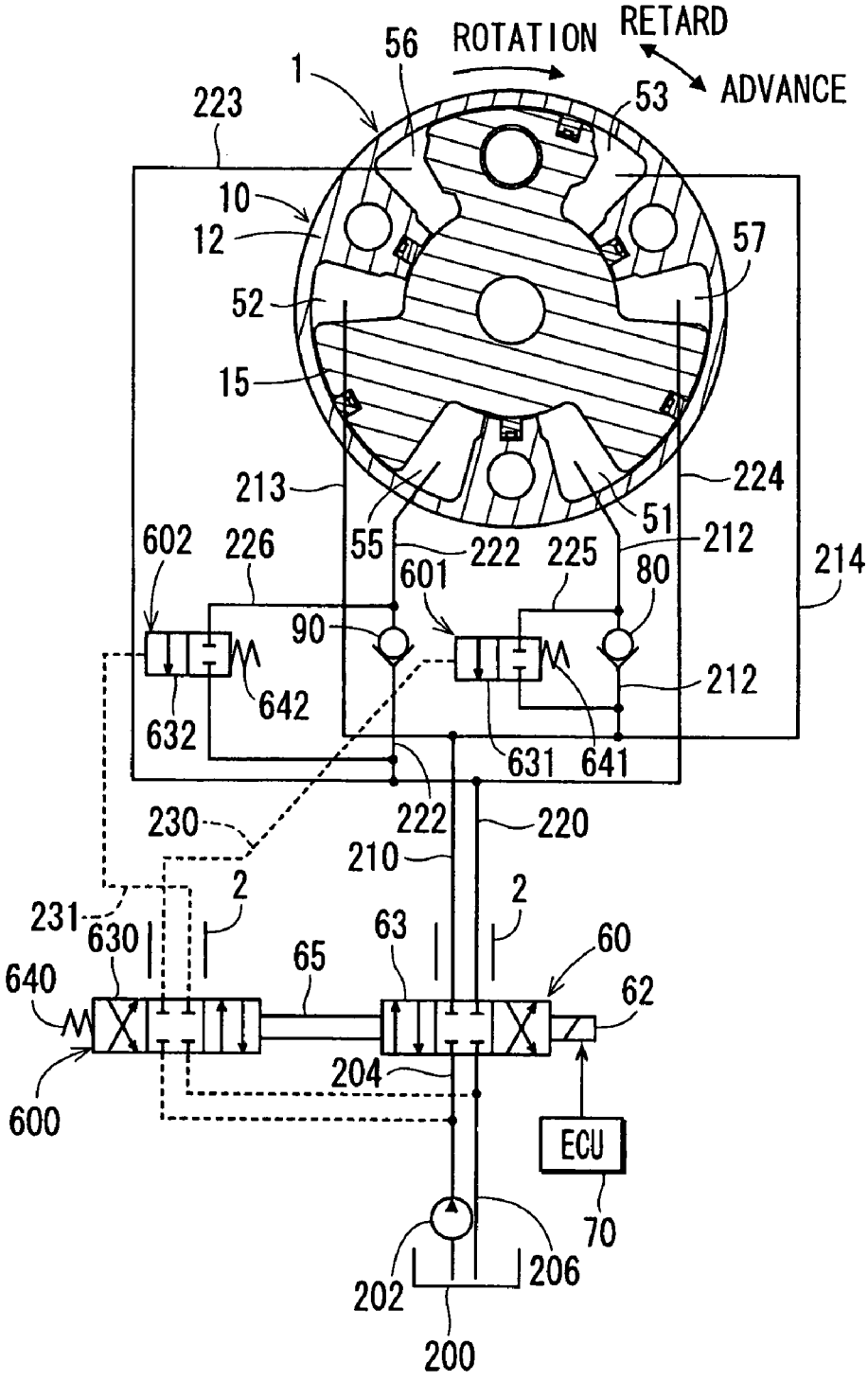
FIG. 16 is a schematic diagram showing a state at intermediate hold operating time of the valve timing controller in the fourth embodiment.

FIGS. 14 to 16 show a fourth embodiment in the present invention. It should be noted that components substantially identical to those in the first embodiment are referred to as identical numerals.

In the fourth embodiment, as is similar to the third embodiment, the advance/retard-switching valve 60 and the drain switch valve 600 are connected in operation, operations of which are controlled by a single FIG. 70. In addition, similarly to the first embodiment, the first control valve 602 and the second control valve 601 adopt a normally closed type control valve.

Accordingly, operations of the vane rotor 15, the advance/retard-switching valve 60, the first one-way valve 90, the second one-way valve 80, the first control valve 602 and the second control valve 601, and the operation of supplying the pilot pressure are similar to that in the first embodiment shown in FIGS. 1, 4 and 5. They operate as shown in FIG. 14 at retard operating time, operate as shown in FIG. 15 at advance operating time and operate as shown in FIG. 16 at intermediate hold operating time.

Fifth Embodiment

Figure 17:
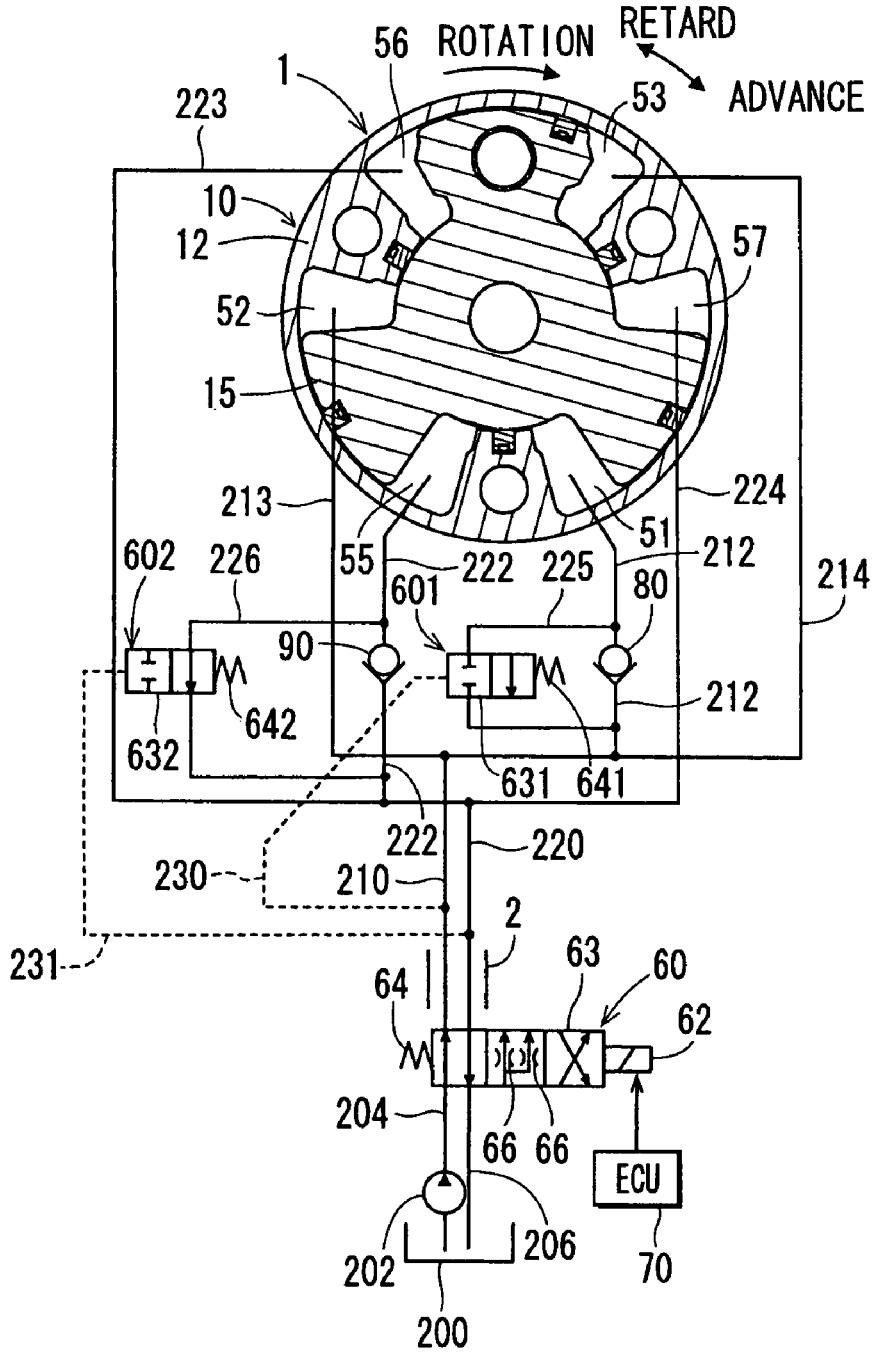
FIG. 17 is a schematic diagram showing a state at retard operating time of a valve timing controller in a fifth embodiment of the present invention.

FIG. 17 shows a fifth embodiment in the present invention. It should be noted that components substantially identical to those in the first embodiment are referred to as identical numerals. The fifth embodiment abolishes the drain switch valve 600 used in the first to fourth embodiments. With respect to the first control valve 602 and the second control valve 601, a normally open type control valve similar to that in the second embodiment is adopted. The first pilot oil passage 231 for operating the first control valve 602 is branched from the advance passage 220 and the second pilot oil passage 230 for operating the second control valve 601 is branched from the retard passage 210. As a result, the first control valve 602 and the second control valve 601 are operated by the control hydraulic pressure of the advance/retard-switching valve 60.

Figure 18:
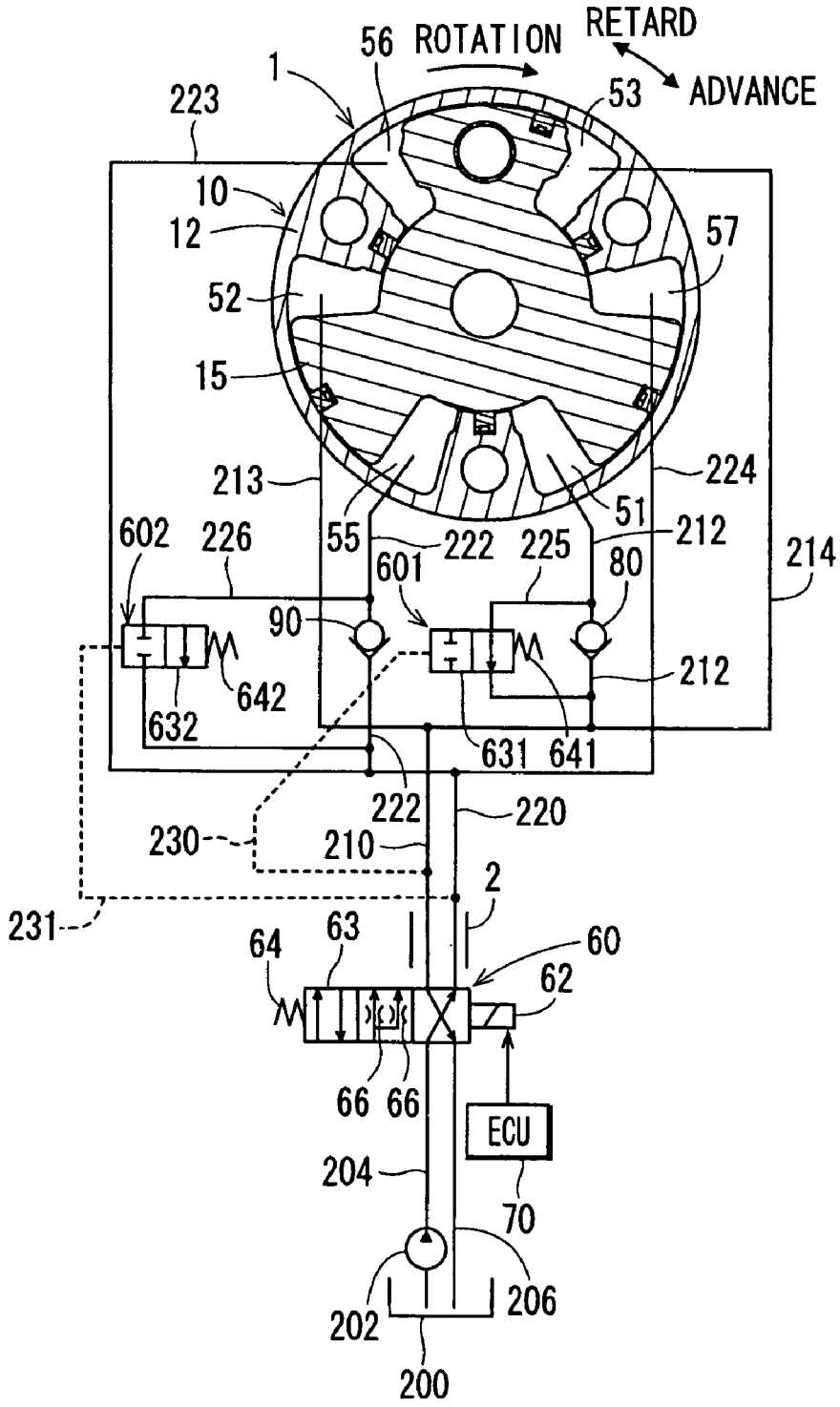
FIG. 18 is a schematic diagram showing a state at advance operating time of the valve timing controller in the fifth embodiment.
Figure 19:
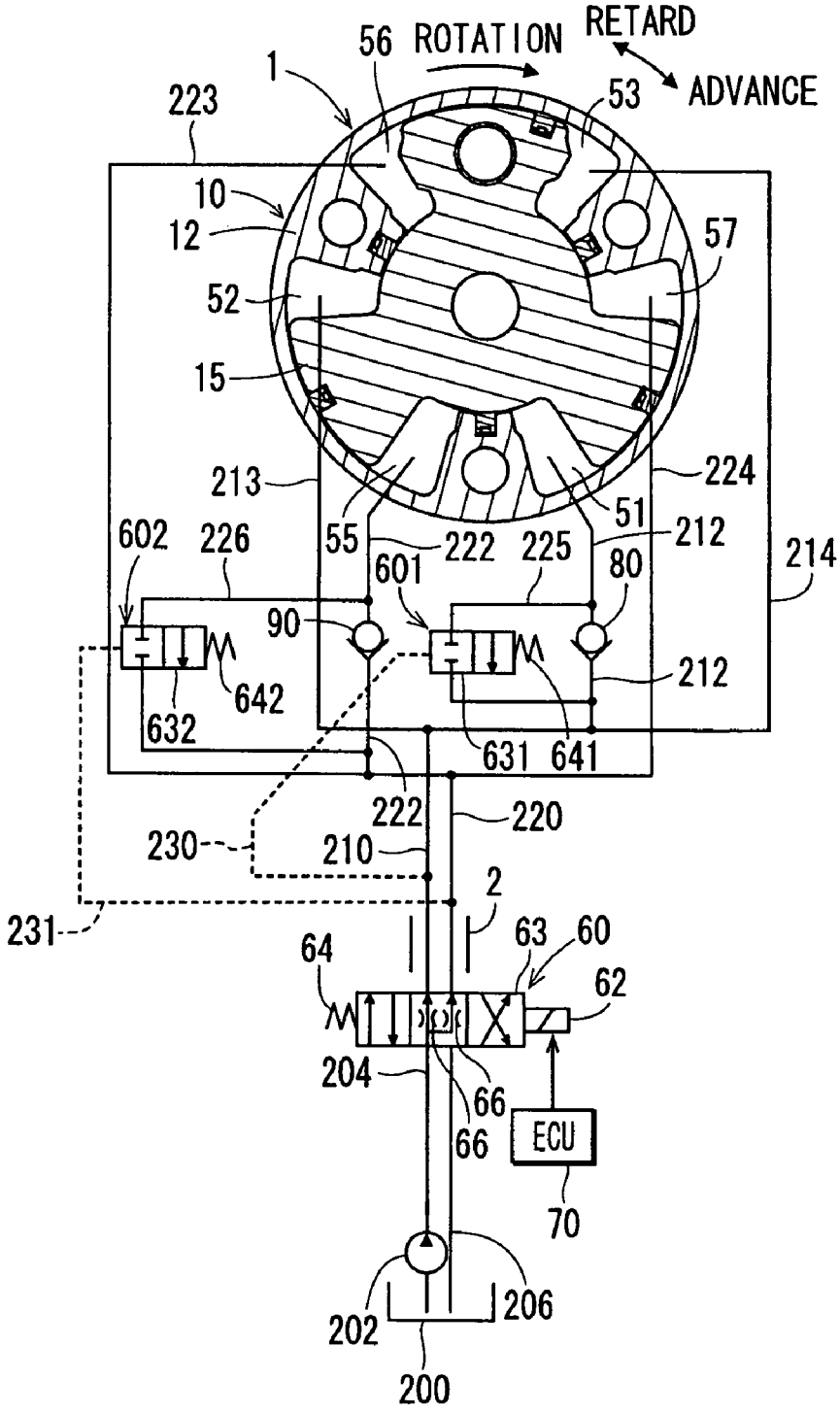
FIG. 19 is a schematic diagram showing a state at intermediate hold operating time of the valve timing controller in the fifth embodiment.
Figure 20:
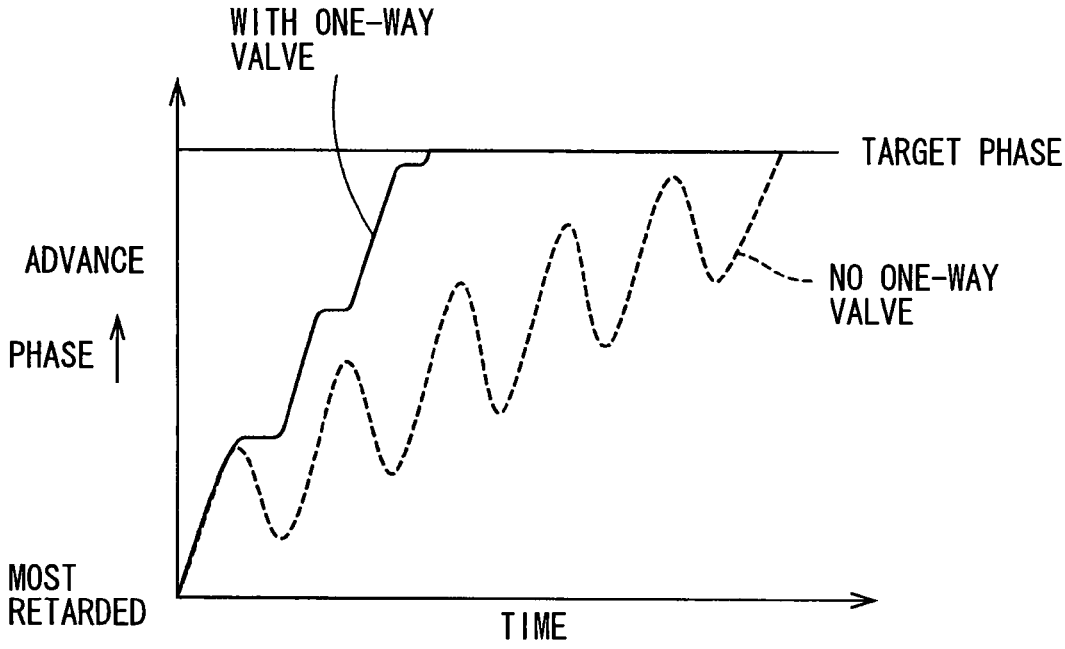
FIG. 20 is a characteristic graph showing a difference of a target phase reach time depending on presence/absence of a first one-way valve.

The operations of the vane rotor 15, the advance/retard-switching valve 60, the first one-way valve 90, the second one-way valve 80, the first control valve 602 and the second control valve 601 are similar to that in the third embodiment shown in FIGS. 11, 12 and 13. They operate as shown in FIG. 17 at retard operating time, operate as shown in FIG. 18 at advance operating time and operate as shown in FIG. 19 at intermediate hold operating time.

At the time of holding the vane rotor 15 at an intermediate position, it is required that the pilot hydraulic pressure is supplied to the first control valve 602 and the second control valve 601 for the closing. Therefore, the advance/retard-switching valve 60 has a restriction structure such that the hydraulic pressure is slightly supplied to both of the retard passage 210 and the advance passage 220 in the position of intermediately holding the spool 63 of the advance/retard-switching valve 60. More specially, the advance/retard-switching valve 60 is provided with orifices for restricting a flow amount of the operating oil as shown in numeral 66 of FIG. 17. The orifice 66 allows a slight amount of the operating oil to be supplied when the spool 63 is held in the intermediate position. That is, in each of the embodiments described above, the advance/retard-switching valve 60 as the intermediate hold means is so structured that the supply of the operating oil is not completely shut due to the leakage, but it is not actively made. In contrast, according to the fifth embodiment, the advance/retard-switching valve 60 as the intermediate hold means has the orifices 66, thereby ensuring the supply of the slight amount of the operating oil.

That is, at intermediate hold operating time, the vane rotor 15 is held at the target phase by balance of a pressure difference between the retard passage 210 and the advance passage 220 and average load torque of the camshaft 3, and both of the first control valve 602 and the second control valve 601 are closed. As a result, the vane rotor 15 is stably held.

Other Embodiment

In each of the embodiments described above, only the advance passage 222 among the plurality of the first advance passages 222, 223 and 224 is provided with the first one-way valve 90, but at least one of the plurality of the first advance passages 222, 223 and 224 may be provided with the first one-way valve 90, for example, all of the advance passages 222, 223 and 224 may be respectively provided with the first one-way valve 90.

In addition, in each of the embodiments described above, only the retard passage 212 among the plurality of the first retard passages 212, 213 and 214 is provided with the second one-way valve 80, but at least one of the plurality of the first retard passages 212, 213 and 214 may be provided with the second one-way valve 80, for example, all of the retard passages 212, 213 and 214 may be respectively provided with the second one-way valve 80.

While only the selected example embodiments have been chosen to illustrate the present invention, it will be apparent to those skilled in the art from this disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A valve timing controller which is provided in a drive force transmission system for transmitting drive force from a drive shaft of an internal combustion engine to a driven shaft opening/closing at least one of an intake valve and an exhaust valve to control opening/closing timing of at least one of the intake valve and the exhaust valve, comprising:

a housing rotating with one of the drive shaft and the driven shaft and including a plurality of accommodation chambers in a rotational direction, each formed in the rotational direction within a predetermined angular range;

a vane rotor rotating with the other of the drive shaft and the driven shaft and including a vane accommodated in the accommodation chamber to be rotated in a retard direction or an advance direction relative to the housing by a pressure of an operating fluid in a retard chamber and an advance chamber formed by dividing the accommodation chamber with the vane;

a first one-way valve provided in a first advance passage for connecting a fluid supply source to the advance chamber to permit flow of the operating fluid from the fluid supply source to the advance chamber and restrict flow of operating fluid from the advance chamber to the fluid supply source;

a second one-way valve provided in a first retard passage for connecting the fluid supply source to the retard chamber to permit flow of the operating fluid from the fluid supply source to the retard chamber and restrict flow of the operating fluid from the retard chamber to the fluid supply source;

a first control valve provided in a second advance passage bypassing the first one-way valve to communicate the fluid supply source with the advance chamber, the first control valve being operated by a pilot pressure, which is a hydraulic pressure supplied from the fluid supply source, to close the second advance passage at the time of performing advance control for relatively rotating the vane rotor in the advance direction and to open the second advance passage at the time of performing retard control for relatively rotating the vane rotor in the retard direction; and a second control valve provided in a second retard passage bypassing the second one-way valve to communicate the fluid supply source with the retard chamber, the second control valve being operated by a pilot pressure, which is a hydraulic pressure supplied from the fluid supply source, to close the second retard passage at the time of performing retard control for relatively rotating the vane rotor in the retard direction and to open the second retard passage at the time of performing advance control for relatively rotating the vane rotor in the advance direction; and an advance/retard-switching valve for switching between a supply of an operating fluid from the fluid supply source to the retard chamber and the advance chamber and a discharge of the operating fluid from the retard chamber and the advance chamber.

2. A valve timing controller according to claim 1, wherein:

the first advance passage and the first retard passage are provided in a plurality of the advance chambers and the retard chambers respectively;

the first one-way valve is provided in at least one of the plurality of the first advance passages; and the second one-way valve is provided in at least one of the plurality of first retard passages.

3. A valve timing controller according to claim 1, wherein:

the advance/retard-switching valve is provided in a position closer to the fluid supply source than a bearing rotatably supporting the driven shaft; and the first one-way valve and the second one-way valve, and the first control valve and the second control valve are provided in a position closer to the retard chamber and the advance chamber than the bearing.

4. A valve timing controller according to claim 1, further comprising:

intermediate hold means which restricts the supply of the operating fluid to the retard chamber and the advance chamber, thereby holding a relative phase angle of the vane rotor to the housing at any target angle in an intermediate position, wherein:

the first control valve closes the second advance passage and the second control valve closes the second retard passage at the time of holding the vane rotor in the intermediate position by the intermediate hold means.

5. A valve timing controller according to claim 1, further comprising:

a drain switch valve for switching between a supply and a non-supply of the pilot pressure to the first control valve and the second control valve, wherein:

the advance/retard-switching valve and the drain switch valve are connected in operation with each other.

6. A valve timing controller according to claim 1, wherein:

the pilot pressure is introduced from the fluid supply source, which is more remote from the first control valve and the second control valve than the advance/retard-switching valve, to the first control valve and the second control valve.

7. A valve timing controller according to claim 1, further comprising:

a drain switch valve for switching between a supply and a non-supply of the pilot pressure to the first control valve and the second control valve.

8. A valve timing controller according to claim 1, wherein:

the first one-way valve and the second one-way valve, and the first control valve and the second control valve are housed in the vane rotor.

9. A valve timing controller according to claim 1, wherein:

the first control valve is structured to move to a position of closing the second advance passage by the pilot pressure;

the second control valve is structured to move to a position of closing the second retard passage by the pilot pressure, further comprising:

a first biasing member for biasing the first control valve toward a position of opening the second advance passage; and a second biasing member for biasing the second control valve toward a position of opening the second retard passage.

10. A valve timing controller according to claim 1, wherein:

the first control valve is structured to move to a position of opening the second advance passage by the pilot pressure;

the second control valve is structured to move to a position of opening the second retard passage by the pilot pressure, further comprising:

a first biasing member for biasing the first control valve toward a position of closing the second advance passage; and a second biasing member for biasing the second control valve toward a position of closing the second retard passage.

11. A valve timing controller which is provided in a drive force transmission system for transmitting drive force from a drive shaft of an internal combustion engine to a driven shaft opening/closing at least one of an intake valve and an exhaust valve to control opening/closing timing of at least one of the intake valve and the exhaust valve, comprising:

a housing rotating with one of the drive shaft and the driven shaft and including a plurality of accommodation chambers in a rotational direction, each formed in the rotational direction within a predetermined angular range;

a vane rotor rotating with the other of the drive shaft and the driven shaft and including a vane accommodated in the accommodation chamber to be rotated in a retard direction or an advance direction relative to the housing by a pressure of an operating fluid in a retard chamber and an advance chamber formed by dividing the accommodation chamber with the vane;

a first one-way valve provided in a first advance passage for connecting a fluid supply source to the advance chamber to permit flow of the operating fluid from the fluid supply source to the advance chamber and restrict flow of operating fluid from the advance chamber to the fluid supply source;

a second one-way valve provided in a first retard passage for connecting the fluid supply source to the retard chamber to permit flow of the operating fluid from the fluid supply source to the retard chamber and restrict flow of the operating fluid from the retard chamber to the fluid supply source;

a first control valve provided in a second advance passage bypassing the first one-way valve to communicate the fluid supply source with the advance chamber, the first control valve being operated by a pilot pressure, which is a hydraulic pressure supplied from the fluid supply source, to close the second advance passage at the time of performing advance control for relatively rotating the vane rotor in the advance direction and to open the second advance passage at the time of performing retard control for relatively rotating the vane rotor in the retard direction;

a second control valve provided in a second retard passage bypassing the second one-way valve to communicate the fluid supply source with the retard chamber, the second control valve being operated by a pilot pressure, which is a hydraulic pressure supplied from the fluid supply source, to close the second retard passage at the time of performing retard control for relatively rotating the vane rotor in the retard direction and to open the second retard passage at the time of performing advance control for relatively rotating the vane rotor in the advance direction;

an advance/retard-switching valve for switching between a supply of an operating fluid from the fluid supply source to the retard chamber and the advance chamber and a discharge of the operating fluid from the retard chamber and the advance chamber; and a drain switch valve for switching between a supply and a non-supply of the pilot pressure to the first control valve and the second control valve, wherein:

the advance/retard-switching valve and the drain switch valve are controlled independently from each other.

* * * * *